US005131210A

United States Patent [19]

Kiya

[11] Patent Number: 5,131,210

[45] Date of Patent: Jul. 21, 1992

[54] METHOD AND APPARATUS FOR COMPRESSING AND BUNDLING AN ARTICLE TO BE PACKED

[75] Inventor: Yoshio Kiya, Hiroshima, Japan

[73] Assignee: Mitsubishi Jukogyo Kabushiki Kaisha, Tokyo, Japan

[21] Appl. No.: 735,147

[22] Filed: Jul. 23, 1991

Related U.S. Application Data

[63] Continuation-in-part of Ser. No. 585,217, Sep. 20, 1990, abandoned.

[30] Foreign Application Priority Data

Sep. 29, 1989 [JP] Japan ..... 1-254864
Nov. 2, 1989 [JP] Japan ..... 1-127915

[51] Int. Cl.[5] ..... B65B 27/12; B65B 13/20; B65B 9/02; B65B 41/06

[52] U.S. Cl. ..... 53/399; 53/436; 53/449; 53/461; 53/176; 53/528; 53/589; 100/3; 100/247

[58] Field of Search ..... 53/399, 436, 438, 449, 53/461, 526, 527, 528, 172, 176, 589; 100/3, 41, 247, 248, 252

[56] References Cited

U.S. PATENT DOCUMENTS 3,500,609 3/1970 Gunyou ..... 53/528
3,962,846 6/1976 Neitzel et al. ..... 53/528
4,318,264 3/1982 Rewitzer ..... 53/528 X
4,360,997 11/1982 Smith, Jr. ..... 53/176 X
4,407,107 10/1983 Smith, Jr. ..... 53/176 X
4,408,438 10/1983 Rewitzer ..... 53/528 X
4,805,383 2/1989 Allwein ..... 53/528
4,942,719 7/1990 Fleissner ..... 53/528 X
4,953,344 9/1990 Wallace ..... 53/528
4,959,948 10/1990 Fleissner ..... 53/528

*Primary Examiner*—Horace M. Culver
*Attorney, Agent, or Firm*—Wenderoth, Lind & Ponack

[57] ABSTRACT

An improved method for compressively packing an article having a bulky tow-like state includes the steps of compressively shaping the article into a cubic or rectangular parallelepiped, automatically wrapping the article from above and below by using flexible upper and lower wrapping materials, automatically applying reinforcements to all of the outer surfaces of the article by making use of a reinforcement lifting device, a reinforcement elevator, a reinforcement feed truck and the like, and bundling the outer surfaces of the wrapped and reinforced article with bundling belts. An apparatus for bundling the article to be packed includes reinforcement mounting devices disposed respectively on a head side and on a guide side portion of the apparatus. Each reinforcement mounting device is provided with a plurality of reinforcement holders which can advance and retreat at such locations that they will not interfere with bundling belt guides. The reinforcements are automatically fed to the head side and the guide side portion of the bundling apparatus at a reinforcement feeding position and are transferred at such a position to the reinforcement holders.

6 Claims, 31 Drawing Sheets 20
19b
19a 21b
87b
19b
87a
19a
21a 88
19b
90b
21a
90a
19a

22

104
112
105
114
109
102
141
C
A
15
110
137
B
132
102'
123
108b'
108b
132
141
D
143
103
A
15
137
144
B
132

METHOD AND APPARATUS FOR COMPRESSING AND BUNDLING AN ARTICLE TO BE PACKED

This is a Continuation-In-Part of U.S. Ser. No. 07/585,217 filed Sept. 20, 1990 and now abandoned.)

BACKGROUND OF THE INVENTION

1. Field of the Invention

The present invention relates to a method for compressive packing in which an article, such as tow for tobacco filters, sanitary cotton, etc., which must be kept free of foreign matter, contamination and the biting effects of bundling belts, is packed continuously and automatically, and also relates to an apparatus for so packing an article.

2. Description of the Related Art

Articles having a small density and a large internal resiliency, such as chemical fibers, natural fibers and the like, are required to be compressively packed into a bale in a manner which prevents their contamination, the introduction of foreign matters thereto, and the biting effects of bundling belts due to forces generated thereby after they are compressed or due to the breakdown of packing materials. Such articles are typically packed with an adhered or laminated type of sheet consisting of a polypropylene Hessian cloth and a polyethylene sheet or with a kraft paper sheet having a polyethylene film lining. Thereafter, the outside of the wrapped article is protected with reinforcement members such as corrugated cardboard sheets or plastic sheets which exhibit excellent rigidity and strength. Then, the articles are bundled with bands or wires. Such method steps are carried out manually in the prior art.

Heretofore, a method of packing an article, such as tow (synthesized fibers) for tobacco filters, which has a small bulk density, and in which the introduction of foreign matters and the generation of contaminants must be prevented, consists of the following steps. First the article to be packed is compressively shaped from either or both of the upward and downward directions within a compressing box, whose upper and lower surfaces are opened and whose four side surfaces can be selectively opened or closed. Thereafter, the four side surfaces of the compression box are opened. Upper and lower reinforcements are then manually preliminarily mounted to upper and lower press seats of a compressive packing machine so as to be applied to the top and bottom of the article. The article is next manually wrapped with upper and lower wrapping materials, which wrapping materials are placed between the reinforcements and the article to be packed. Thereafter, two to four pieces of reinforcements are manually attached to the side surfaces of the article to be packed. Subsequently, the reinforcements are manually bundled by a number of bundling belts. Then the compressive forces on the articles are released.

In the following, one example of such a method for compressively packing tow made of acetate for use in tobacco filters will be described with reference to FIGS. 10 and 11. In these figures, FIG. 10(*a*) is a front view of a compressive packing machine in the prior art, and FIG. 11 is a cross-sectional view taken along line XI—XI in FIG. 10(*a*). In addition, FIG. 1 outlines a series of packing steps including the steps of wrapping, of mounting reinforcements and of manually bundling the reinforcements in a prior art compressive packing machine. It should be noted that although FIG. 1 has been prepared for describing the present invention, FIG. 1 will now be used for describing the manual steps in the prior art compressive packing method.

An article to be packed, such as acetate tow, is stored in an enclosure box 1 shown in FIG. 10. Thereafter the enclosure box is carried into the center of a compressive packing machine (FIG. 10*a*) by transport means such as a conveyor (not shown), and is positioned there by a positioning device 2.

Reinforcements 5*a* and 5*b*, such as corrugated cardboard sheets, kraft paper sheets or plastic sheets are manually mounted to an upper press seat 3 and a lower press seat 4 of the compressive packing machine jointly with flexible wrapping materials 6*a* and 6*b* such as an adhered or laminated sheet of polypropylene Hessian cloth and polyethylene via metal retainers 7*a* and 7*b*, respectively. It is to be noted that when the enclosure box 1 comes to the center of the compressive packing machine, the upper press seat 3 is at the upper limit (illustrated) position with the above-described reinforcement 5*a* and wrapping material 6*a* mounted thereto. The lower press seat 4 is located proximate the top of a fixed frame 8 (the upper limit position) with the reinforcement 5*b* and wrapping material 6*b* mounted thereto. And, large doors 10*a* and 10*b* and a small door 11 of a compressing box 9 are in a closed state. It is to be noted that the state depicted by double-dot chain lines of the large doors 10*a* and 10*b* in FIG. 11 is an opened state.

Under the above-described state, the enclosure box 1 is once lowered to a neutral position 13 by an enclosure box elevator 12 associated with the compressive packing machine. There a tow receiver 14 of the enclosure box 1 is opened by a tow receiver opening/closing device (not shown) disposed at the bottom of the enclosure box, and the enclosure box 1 is continuously lowered to a position at which the tow receiver 14 overlaps the top of the fixed frame 8 (the lower limit position). The lower press seat 4 is lowered by a hydraulic cylinder 16 or the like while supporting tow 15 within the enclosure box 1 via the reinforcement 5*b* and the wrapping material 6*b*, and comes to a lower limit position 17. Consequently, the tow 15 within the enclosure box 1, which is to be packed, is transferred into the compressing box 9 with a part thereof left within the enclosure box 1.

On the other hand, the upper press seat 3 is lowered by a hydraulic cylinder 18 or the like as accompanied by the reinforcement 5*a* and the wrapping material 6*a*, and compresses the tow 15 into the compressing box 9 under a predetermined compressing force until the tow assumes a predetermined height. Subsequently, the large doors 10*a* and 10*b* and the small door 11 of the compressing box 9 are opened either manually or automatically. And thereafter, the steps of wrapping the tow with the wrapping materials, of mounting the reinforcements and of bundling are carried out.

In the following, the above-described series of manual packing steps will be explained with reference to FIG. 1. In the compressive packing machine, after the tow 15 to be packed has been compressed within the compressing box 9 to the predetermined height with the predetermined compressing force, and the large doors 10*a* and 10*b* and the small door 11 have been opened, the tow is manually wrapped with the lower wrapping material 6*b* under the compressed condition of the tow block (FIG. 1(b)). This condition is maintained until the wrapping and bundling steps have been completed.

Subsequently, as shown in FIG. 1(*c*), the tow is manually wrapped with the upper wrapping material 6*a* in such a manner that the wrapping material 6*a* is overlapped with the upper edge of the lower wrapping material 6*b*. After the tow is wrapped with the upper and lower wrapping materials 6*a* and 6*b*, end portion treatments (folding) of the upper reinforcement 5*a* and the lower reinforcement 5*b* are manually carried out as shown in FIG. 1(*d*). (The ears of the respective reinforcements to be folded are denoted by 74*a*, 74*b* and 75*a*, 75*b*, respectively.) Thereafter, as shown in FIG. 1(*f*), bundling belts 20 such as bands (or wires) are passed around the top, bottom and sides of the wrapped tow using band-(or wire-)passing grooves 3*a* of the upper press seat 3 shown in FIG. 10(*b*) and band-(or wire-)passing grooves 4*a* of the lower press seat 4 shown in FIG. 10(*c*) as guides. Thus, opposite end surfaces of the tow block are bundled. At this time, since the bundling belts 20 such as bands (or wires) loosely bundle the tow block (including the upper and lower wrapping materials), side surface reinforcements 19*a* and 19*b* are inserted into gaps between the bundling belts 20 and the tow block as shown in FIG. FIG. 1(*f*). And, in succession, end surface reinforcements 21*a* and 21*b* are manually applied to the tow block as shown in FIG. 1(*g*).

Subsequently, bundling belts 88 (bands or wires) are passed around the opposite ends of the tow block using passing grooves (not shown) extending perpendicular to the band-(or wire-)passing grooves 3*a* and 4*a* provided in the upper press seat 3 and the lower press seat 4. Then the tow block is released from the compressed condition (by the raising of the upper press seat 3), and expands to a state constrained by the bands (or wires). Thereafter, the opposite end portions 90*a* and 90*b* of the side surface reinforcements 19*a* and 19*b* are manually treated (folded) as shown in FIG. 1(*h*). Finally, the reinforcements are bundled by bands 22 to complete the formation of a compressively packed bale. Next, when the bale has been taken out of the compressive packing machine either manually or by a bale take-out device (not shown), a new reinforcement 5*b* and new packing material 6*b* are manually mounted to the lower press seat 4 and fixed thereto by means of a metal retainer 7*b* as shown in FIG. 10(*b*).

Successively, the hydraulic cylinder 18 is actuated by manipulating a push-button (not shown). Hence, its ram is lowered, and the upper press seat 3 descends to a level convenient for mounting the upper reinforcement 5*a* and the upper wrapping material 6*a* thereto. At this level of the upper press seat 3, the reinforcement 5*a* and the wrapping material 6*a* are manually mounted to the upper press seat 3 in a similar manner to that described above, and are fixed thereto by means of a metal retainer 7*a*.

After the above-described manual work has been finished, in response to a manipulation of a push-button (not shown), the upper press seat 3 is raised by the hydraulic cylinder 18 as accompanied by the reinforcement 5*a* and the wrapping material 6*a*, and the machine is restored to the state shown in FIG. 10(*a*). On the other hand, the bottom tow receiver 14 of the emptied enclosure box is closed, the enclosure box 1 is raised to the upper limit position by the elevator 12, the positioning device is opened, and the enclosure box 1 is transported to the outside of the compressive packing machine by a conveyor device (not shown), thereby completing one cycle of operation.

Next, an apparatus for bundling an article to be packed in the prior art will be explained with reference to FIGS. 18, 19 and 20. In these figures, reference numeral 101 generally designates a bundling apparatus including a head side portion 102 and a guide side portion 103 opposed to each other. The head side portion 102 is supported on a movable frame 105 which can be displaced by a cylinder 104. Also, there is a table 107 which can be made to advance or retreat by a cylinder 106. A plurality of bundling belt guides 108*a* of the head side portion 102 are fixed to a frame 115 jointly with a bundling machine 110. This bundling machine 110 (including the guides 108*a*) is movable by an electric motor cylinder 109. It is to be noted that reference numeral 102' in FIG. 19 designates a standby position of the head side portion 102.

In addition, a bale take-out conveyor 112 is movable by a cylinder 114, and is supported on movable table 105 so that it is also movable by cylinder 104. The guide side portion 103 includes a plurality of bundling belt guides 108*b* juxtaposed on a frame 119. This frame 119 is supported on a table 118 which can advance and retreat along a frame 116 as driven by a cylinder 117. Bale push-out pushers 120*a* and 120*b* are provided on frame 119.

When an article 123 is to be bundled, the bundling machine 110 and the bundling belt guides 108*a* of the head side portion 102 of the bundling apparatus 101 are advanced to position 108*a'*, while the bundling belt guides 108*b* of the guide side portion 103 are advanced to the position 108*b'*. At these positions, bundling belts 125 such as bands are payed out from the bundling machine 10. The bundling belts 125 are wrapped around the article 123 to be packed as guided by the bundling belt guide 108*a*, bundling belt passing grooves 124 in an upper press seat 122*a*, the bundling belt guide 108*b* and bundling belt passing grooves 124 in a lower press seat 122*b*. Thus, the bundling belts 125 fasten and bundle the article 123 to be packed. More particularly, for each of the juxtaposed bundling belt guides, the bundling machine 110 sequentially advances, retreats and moves transversely by necessary amounts to apply the bundling belts 125 one by one.

When the article 123 to be packed has been bundled with the belts 125, the head side portion of the bundling apparatus 101 returns to its original position, the bundling machine 110 moves to position B , the bale take-out conveyor 112 moves to position A as interlocked with the former, the conveyor begins to rotate, the article 123 is pushed by the cylinder 114 to a receiving position proximate the conveyor, and the article 123 is loaded on the bale take-out conveyor 112 by a pushing member 126 operated by the bale push-out pushers 120*a* and 120*b* provided on the guide side portion 103. This conveyor 112 is once stopped, and then retracted by the cylinder 114 to its original position. Then, the article 123 is removed from the bundling machine and is sent to the next station.

However, in the above-described type of packing method in the prior art, in order to reduce the time of one cycle and to lighten a worker's load, it is necessary to preliminarily assemble the reinforcements 5*a* and 5*b* and the packing materials 6*a* and 6*b* into respective press seats and also to store them in a folded state for convenience. Accordingly there is a shortcoming in the prior art in that human labor for this work and a storage facility are necessary. In addition, although the mounting of the reinforcement 5*b* and the wrapping material 6*b* to the lower press seat 4 is not so laborious, the mounting of the reinforcement 5*a* and the wrapping material 6*a* to the upper press seat 3 requires the worker's face to be turned upward. And moreover, these materials typically weight several kilograms, so that such work necessitates considerable labor whereby the worker becomes very fatigued.

Furthermore, it is necessary to preliminarily cut the bands and wires (bundling materials) into predetermined lengths and to store them. Also since the mounting of the side surface reinforcements 19*a* and 19*b* is carried out manually, the labor of two to four workers is typically necessary, although this number depends upon the experience of the workers. Consequently, there are shortcomings in that there is a high degree of danger to human life during such manual work or in that the number of working mistakes is large. Moreover, the above-described operations have a very dangerous nature because all of such steps are carried out in the neighborhood of a press machine of several tens to several hundreds of tons. Finally, the appearance of packed articles according to the prior art largely depends upon the experience of the workers.

Still further, in the prior art, an article to be packed having a small bulk density and capable of generating a large resilient force was wrapped with flexible wrapping material such as a laminated or adhered sheet consisting of polypropylene Hessian cloth and a polyethylene sheet and the wrapped article was bundled with bundling belts either manually or automatically. But when the compressive force was released, the bundling belts would bite into the packed bale due to the tendency of the article to expand. Furthermore, the wrapping material would be broken as a result of this biting, in turn resulting in the contamination of the packed article or the introduction of foreign matters into the article. In addition, in the case where the packed article is unpacked for use, there is a problem in that twining, entangling or the like arises due to the biting of the bundling belts into the fibers of the article. Because of these problems, the article was bundled with bundling belts after reinforcements, such as corrugated cardboard sheets, had been applied to the outside of the wrapping materials.

FIG. 12 shows another prior art method of packing an article. In this figure, wrapping materials 130 such as sheets and reinforcements 131*a* and 131*b* are applied to the upper and lower surfaces of the tow block as shown in FIG. 12(*a*). Surface reinforcements 132 are applied as shown in FIG. 12(*b*). Then, only bundling belts 125 are applied as shown in FIG. 12(*c*). It is to be noted that the chain lines in FIG. 12(*c*) represent that the article is bundled sequentially with the bundling belts 125. FIG. 12(*d*) shows the appearance of a bundled package.

It is to be noted that a technique is known in which the article is wrapped with wrapping material 130 and has the upper surface reinforcement 131*a* and the lower surface reinforcement 131*b* automatically applied thereto. However, the side surface reinforcements 132 were applied manually by a plurality of workers in the direction shown by arrow x in FIG. 20, after the bundling was completed by the bundling machine, i.e. while the article 123 to be packed was in contact with the inner side surface bundling belts, but before a compressive force exerted on the article by the compressing machine was released. Since such work is carried out in the neighborhood of a large-size press machine, and also within an operating range of the bundling machine, it is of an extremely dangerous nature. In addition, since the other portions of the bundling apparatus are automated, a short cycle time can not be achieved because the above-noted manual operation acts as a neck in the cycle.

SUMMARY OF THE INVENTION

It is therefore one object of the present invention to provide an improved method and apparatus for compressive packing in which the above-described problems in the prior art are resolved.

To achieve this object, the present invention provides a method for compressive packing consisting of the steps of compressively shaping an article in a bulky tow-like state into a cubic or regular parallelepiped form, thereafter automatically wrapping the same from above and below with upper and lower flexible wrapping materials, then automatically applying reinforcements to all of the outer surfaces by operating a reinforcement lifting device, a reinforcement elevator, a reinforcement feed truck and the like, and bundling the outer surfaces thereof with bundling belts.

Further, the present invention also provides an apparatus for bundling an article, comprising reinforcement mounting devices disposed respectively on the head side and on the guide side portions of the apparatus, the reinforcement mounting devices being provided with a plurality of reinforcement holders able to advance and retract at such locations in a non-interfering manner with respect to bundling belt guides. The reinforcements are automatically fed to the head side and the guide side portions of the bundling apparatus at a reinforcement feeding position and are transferred to the reinforcement holders. Preferably, the reinforcement holders are vacuum suction pads.

In the operation of the above-featured bundling apparatus, after the article is placed at a bundling position located symmetrically with respect to the head side and guide side portions of the bundling apparatus (position A in FIG. 16), the reinforcement automatic mounting devices are advanced towards the side surfaces of the article. The bundling belt guides are stopped leaving a little clearance from the upper press seat and the lower press seat. The side surface reinforcements are urged against the side surfaces of the article via reinforcement holders such as vacuum suction pads. When the bundling of the article is completed, the reinforcement holders release the reinforcements, and the bundling apparatus and the reinforcement automatic mounting devices are both retracted to their original positions. Thereafter, the head side and the guide side portions of the bundling apparatus as well as the reinforcement automatic mounting devices are moved to the reinforcement feeding position (position B in FIG. 16). There, side surface reinforcements are automatically fed to the reinforcement holders of the reinforcement automatic mounting devices by means of the reinforcement feeding device.

According to the present invention, since there is no need to preliminarily combine a reinforcement and a wrapping material set by set as is the case with the prior art method, human labor can be reduced, and it is unnecessary to provide temporary storage space. Also according to the present invention, since the compressive packing operation is carried out automatically, persons are not needed to perform the simple labor associated with the packing operation, nor are persons required to perform dangerous work. And moreover, productivity can be improved by shortening the total cycle time necessary for making one package. Furthermore, if the bundling apparatus according to the present invention is used, side surface reinforcements can be automatically applied to an article. Hence, workers are not required to perform dangerous work, whereby safety is improved and manpower can be reduced. Moreover, the appearance of the packages is determined without being based on the skill of workers. Also, the cycle time can be shortened and productivity can be improved.

The above-mentioned and other objects, features and advantages of the present invention will become more apparent by referring to the following description of preferred embodiments of the invention taken in conjunction with the accompanying drawings.

BRIEF DESCRIPTION OF THE DRAWINGS

In the accompanying drawings:

FIGS. 10(*b*) and 10(*c*) are detailed views of essential parts of the machine shown in FIG. 10(*a*);

DETAILED DESCRIPTION OF THE PREFERRED EMBODIMENTS

Figure 1A:
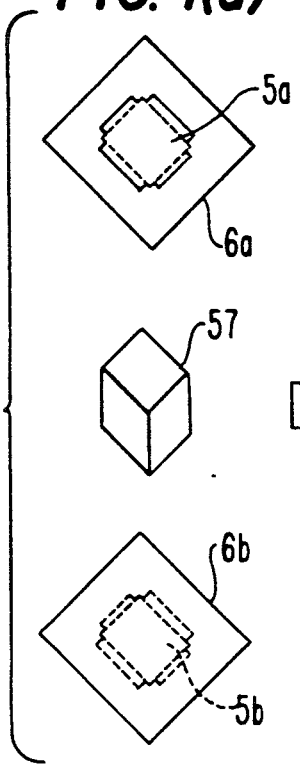
FIGS. 1(*a*)-1(*e*) are schematic diagrams showing the successive steps in the method for compressively packing an article according to the present invention.
Figure 1B:
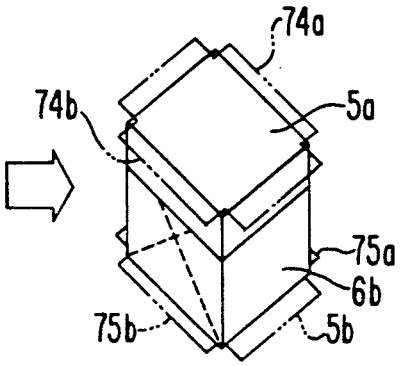
Figure 1C:
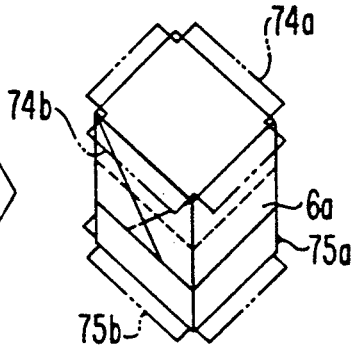
Figure 1C:
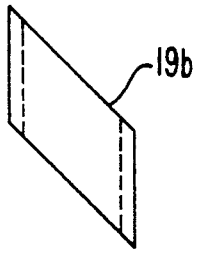
Figure 1D:
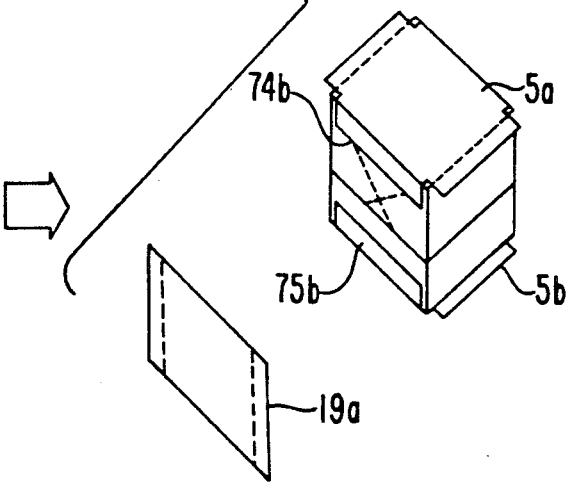
Figure 1E:
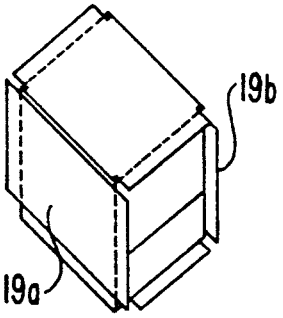
Figures 1F, 1G, 1H, 1I:
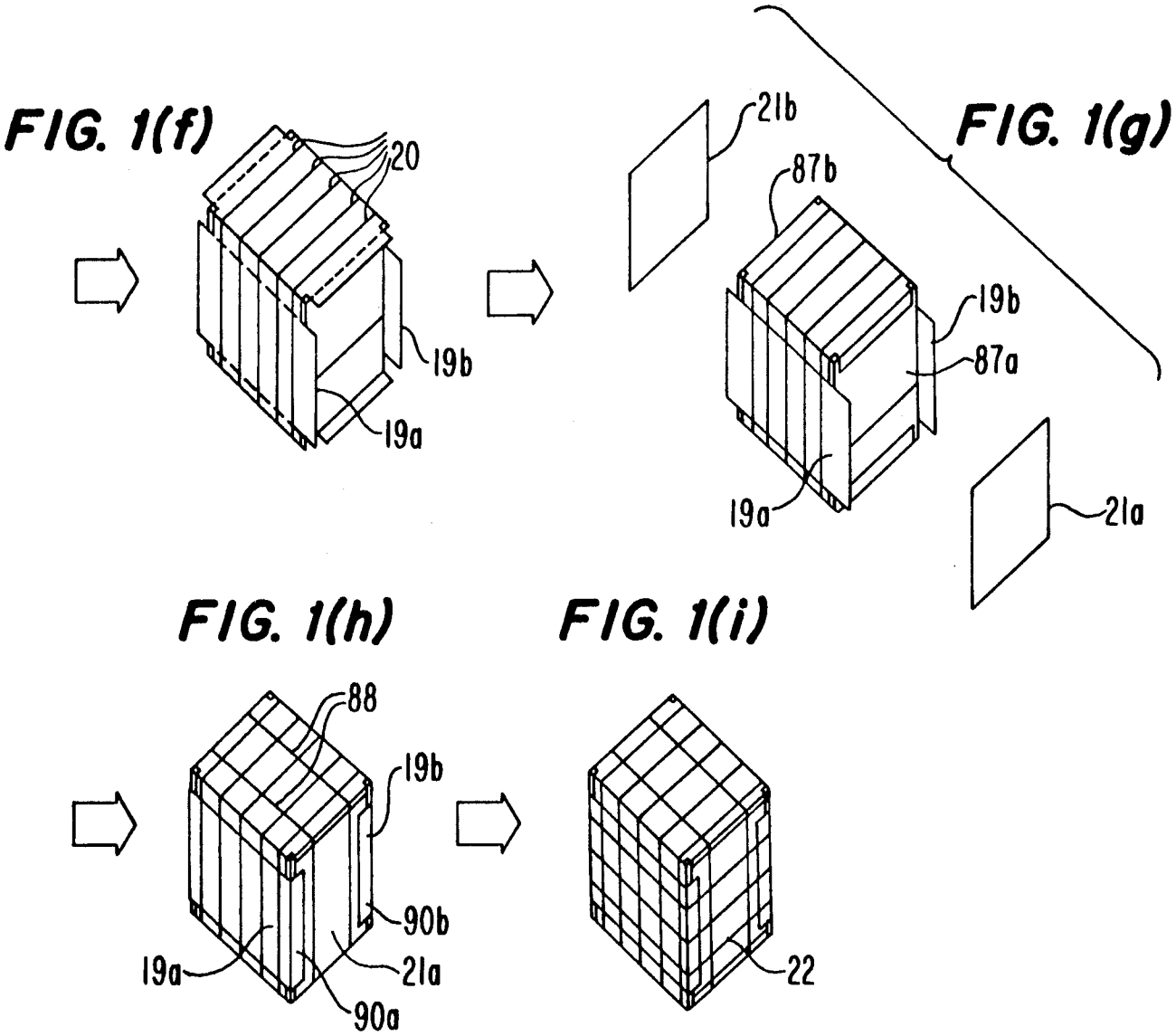
Figure 2:
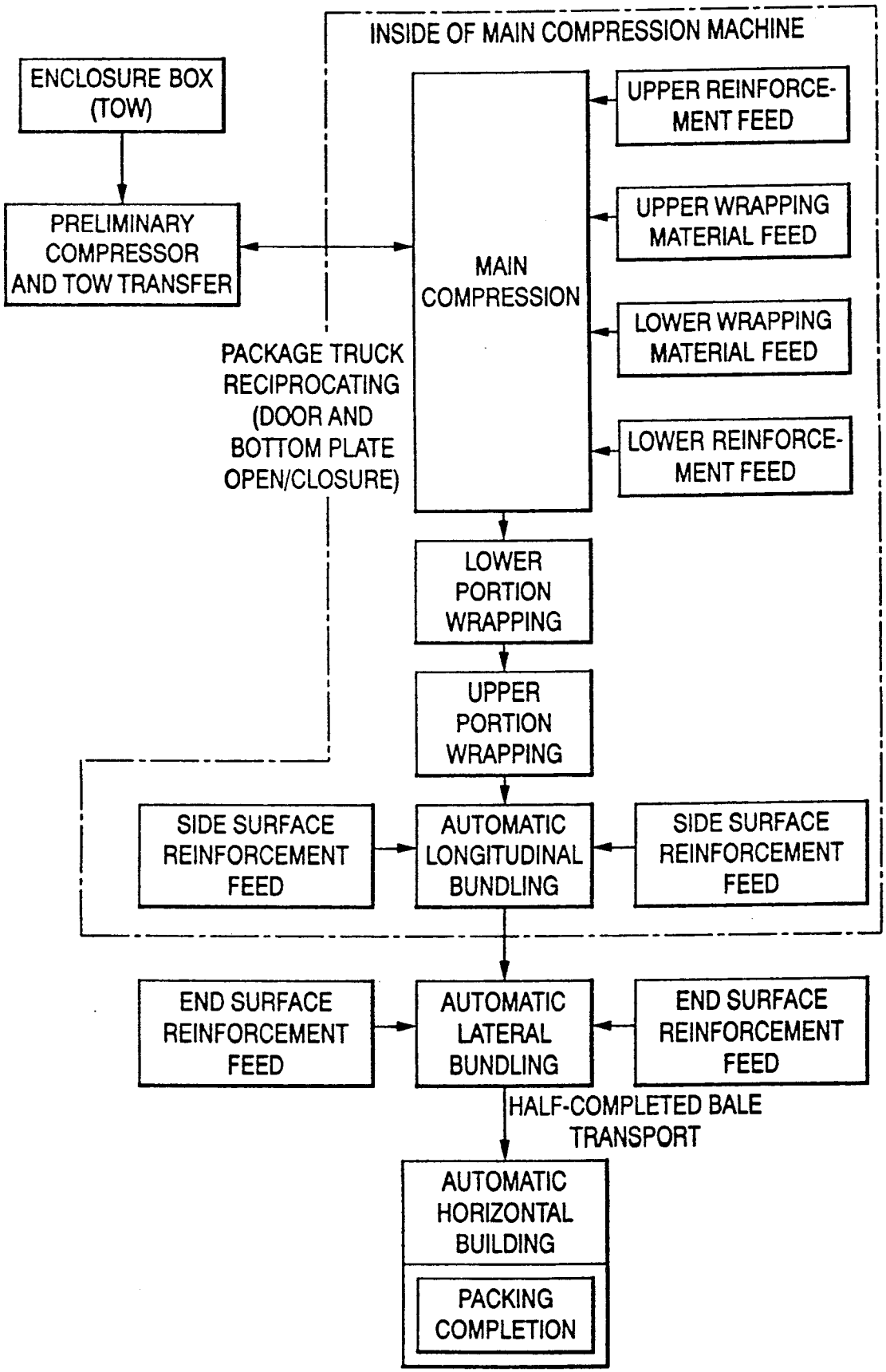
FIG. 2 is a block diagram of a first embodiment of a method for compressively packing an article according to the present invention.

In the following, the first preferred embodiment of a method for compressive packing according to the present invention will be described. FIGS. 1 to 9 illustrate the first preferred embodiment of the present invention, FIG. 1 generally showing the successive steps in the packing method according to the present invention, and FIG. 2 showing the timing of the feeding of wrapping materials, reinforcements and bundling materials to principal devices carrying out the packing method according to the present invention.

The present invention has been developed in order to resolve the problems caused by the introduction of foreign matters to the article due to damage of the wrapping materials, by the contamination of the article from a sanitary view point, or by the biting of bundling belts into wrapping materials and tow resulting from the tendency of the article to expand as is the case with a compressively packed bale, especially a packed bale of acetate tow or the like for use as tobacco filters. In this respect, the present invention relates to a completely automatic method for compressively shaping an article such as tow into a block having a predetermined height, wrapping the article with flexible wrapping materials, applying so-called reinforcements having larger strength and rigidity than the above-mentioned wrapping materials to all of the outer surfaces of the wrapped article, and then bundling the article with bands, wires, etc.

Figure 3:
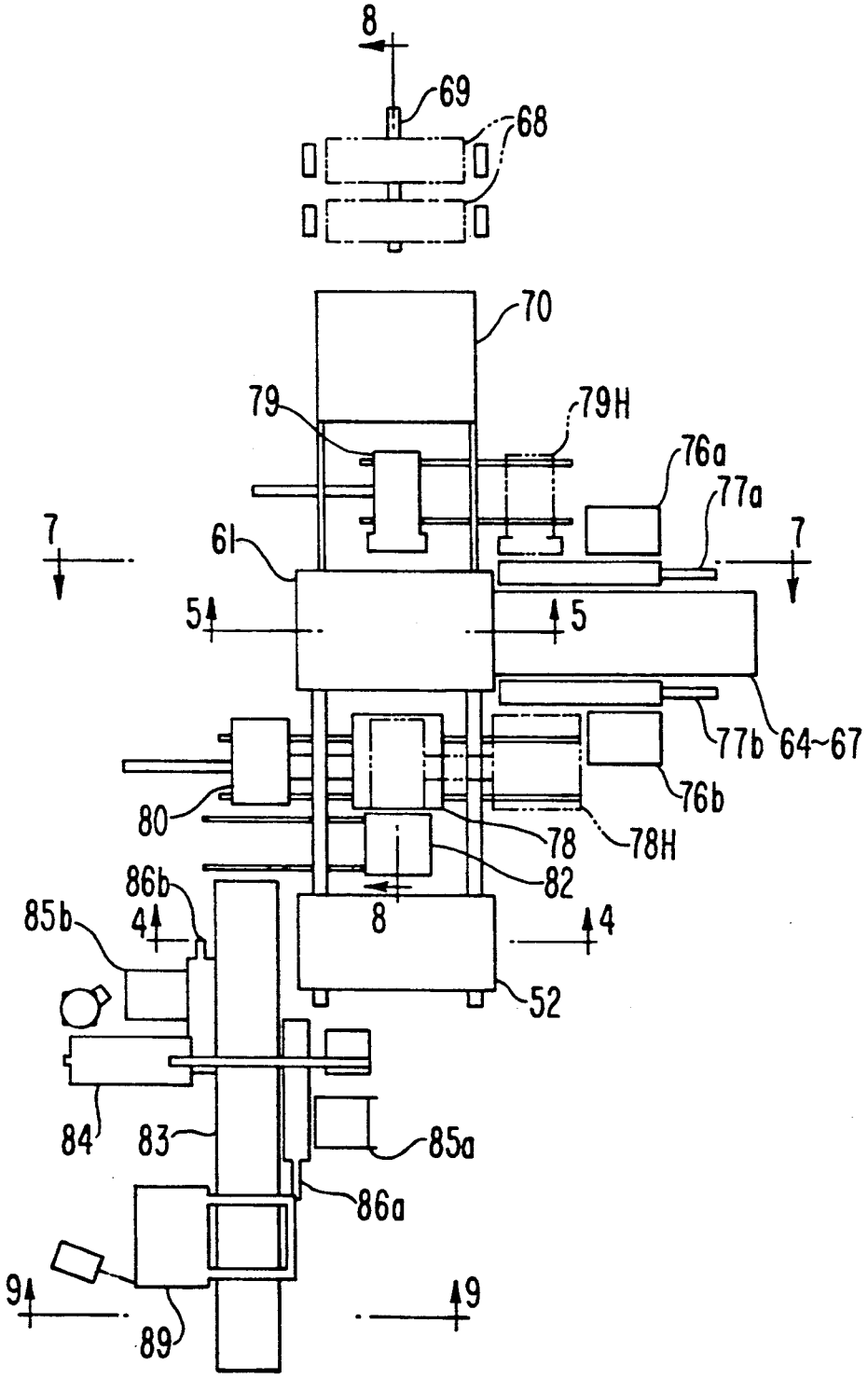
FIG. 3 is a plan view of an apparatus for compressively packing an article according to the present invention.
Figure 6:
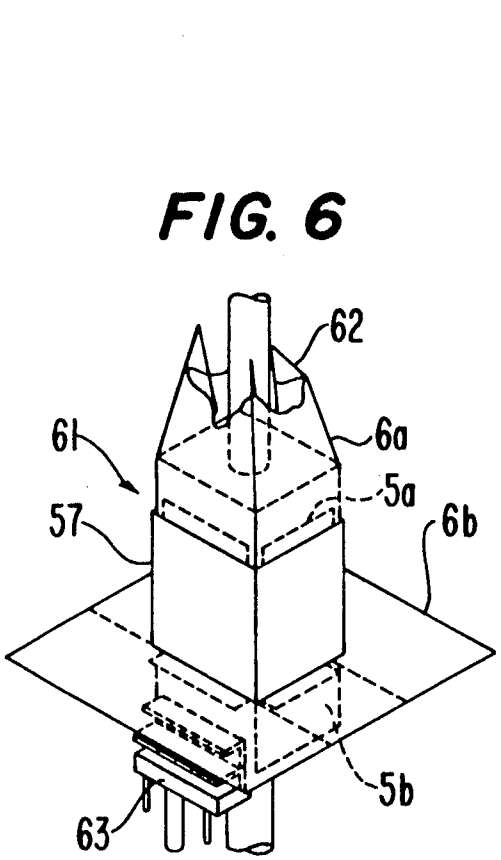
FIG. 6 is a view similar to FIG. 5 showing the state where compression has been completed.
Figure 4:
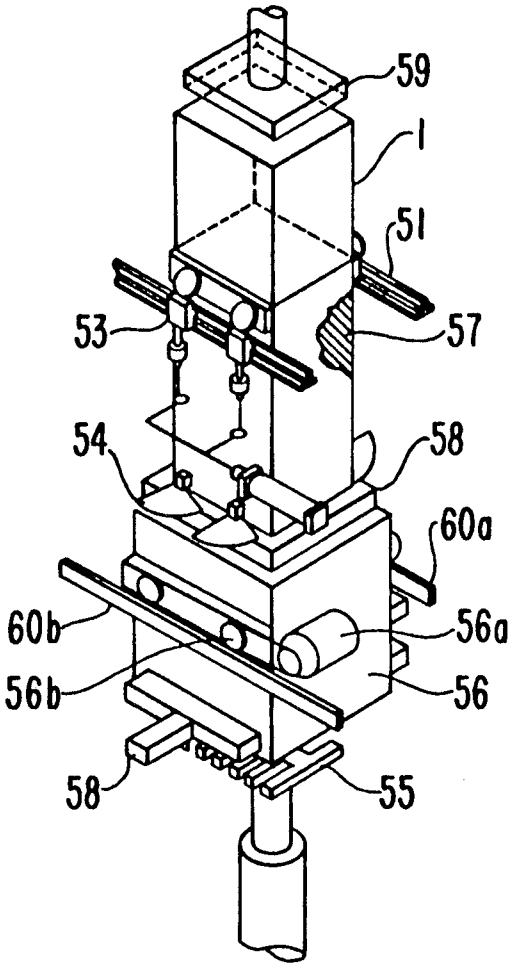
FIG. 4 is a perspective view of that portion of the apparatus intersected by line 4—4 in FIG. 3.

FIG. 3 is a plan view showing a general layout of the apparatus used to practice the method according to the first preferred embodiment of the present invention, and FIG. 4 is a perspective view of a portion of the apparatus taken at line 4—4 in FIG. 3. In FIG. 4, after tow has been stored in an enclosure box 1, it is conveyed by a conveyor 51 to the center of a preliminary compression and transfer machine 52 (FIG. 3). Here, after the enclosure box 1 has been positioned at the center of the above-described tow transfer machine 52 by a positioning device (not shown), it is lowered by an elevator 53. Further, a tow receiver 54 is opened in the illustrated manner by a tow receiver opening/closing device at the bottom of the enclosure box 1. Prior to this operation, a receiving seat 55 in FIG. 4 is positioned at the top of a self-traveling type compression box 56 while extending therethrough. The self-traveling type compression box 56 has a motor 56*a* mounted thereto for driving the wheels 56*b* thereof. Accordingly, when the "opening" of the tow receiver 54 at the bottom of the above-mentioned enclosure box is completed, the tow 57 within the enclosure box 1 is transferred onto the receiving seat 55. Thereafter, the receiving seat 55 descends while supporting the tow 57, and stops at a level somewhat higher than a tow receiver 58 at the bottom of the self-traveling type compression box 56. Subsequently, an upper press seat 59 descends and applies pressure against the tow 57 within the enclosure box 1 until the self-traveling type compression box 56 is completely filled with tow. Next, when the upper press seat 59 is raised again, the receiving seat 55 descends and returns to the state shown in FIG. 6.

Figure 7:
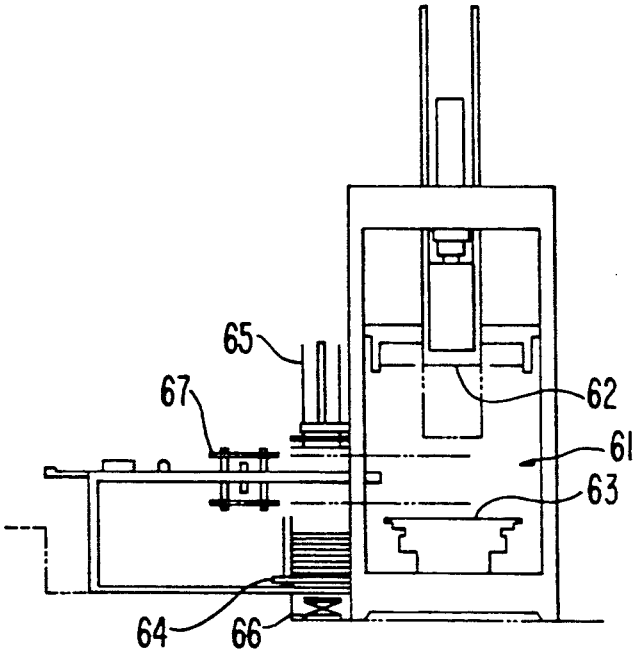
FIG. 7 is a cross-sectional view taken along line 7—7 in FIG. 3.
Figure 9:
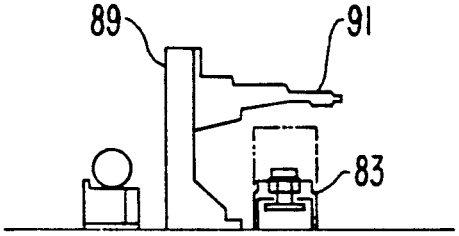
FIG. 9 is a cross-sectional view taken along line 9—9 in FIG. 3.

Midway of the descending of this receiving seat 55, the tow 57 within the self-traveling type compression box 56 is automatically transferred onto the tow receiver 58 associated with the self-traveling type compression box. When the transfer of the tow from the enclosure box 1 to the self-traveling type compression box 56 has been completed, the motor 56*a* of the self-traveling type compression box 56 rotates the rollers 56*b* such that the compression box 56 travels by itself along traveling rails 60*a* and 60*b* to a main compression device 61. There, the compression box 56 is positioned at the center of the main compression device 61 by a positioning device (not shown). On the other hand, the enclosure box 1 emptied at the center of the preliminary compression and tow transfer machine 52 is sent back to the upstream installation by the conveyor device 51. As shown in FIG. 7, which is a cross section taken along line 7—7 in FIG. 3, and in FIG. 8, which is a cross section taken along line 8—8 in FIG. 3, the main compression device 61 is associated with an upper wrapping device 62 and a lower wrapping device 63. Before the above-mentioned self-traveling type compression box 56 enters the main compression device 61, the upper and lower reinforcements 5*a* and 5*b* and the upper and lower wrapping materials 6*a* and 63.

First, these members will be described in general with reference to FIGS. 3, 7, 8 and 1(*a*). The upper and lower reinforcements 5*a* and 5*b* are preliminarily fed to the upper and lower wrapping devices 62 and 63. In FIG. 7, the upper and lower reinforcements 5*a* and 5*b* are stacked on a reinforcement stocker 64. A reinforcement lifting device 65 is disposed above the stocker 64, and a reinforcement elevator 66 is disposed under the stocker 64. At first, one of the reinforcements on the stocker 64 is lifted by the reinforcement lifting device 65. Thereafter, a reinforcement feed truck 67 travels by itself to right under the reinforcement lifting device 65, and receives the reinforcement 5*a* (the upper reinforcement) lifted up by the above-mentioned reinforcement lifting device 65. Furthermore, it picks up one reinforcement 5*b* (the lower reinforcement). Thereafter, the reinforcement feed truck 67 comes to the center of the main compression device 61 while holding the upper reinforcement 5*a* and the lower reinforcement 5*b*. There the reinforcement feed truck 67 feeds the upper reinforcement 5*a* to the upper wrapping device 62 and the lower reinforcement 5*b* to the lower wrapping device 63, and thereafter returns to the state shown in FIG. 7. Then, the lower wrapping material 6*b* is fed to the lower wrapping device 63 and the upper wrapping material 6*a* is fed to the upper wrapping device 62.

Figure 8:
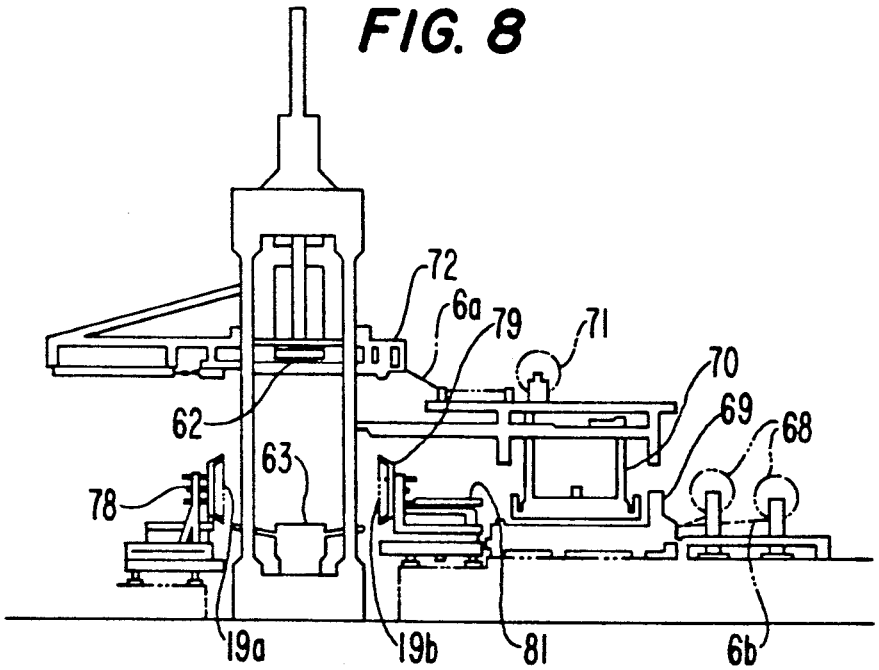
FIG. 8 is a cross-sectional view taken along line 8—8 in FIG. 3.
Figure 10A:
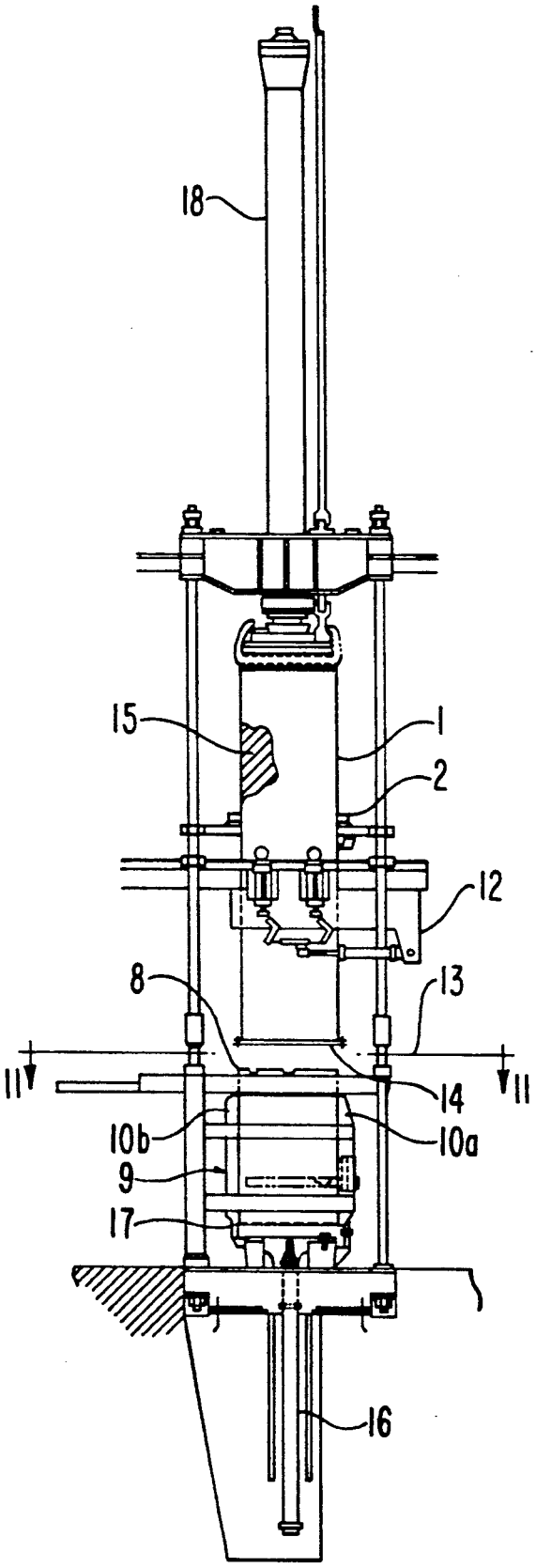
FIG. 10(a) (PRIOR ART)
FIG. 10(*a*) is a front view of a compressive packing machine in the prior art.
Figure 10B:
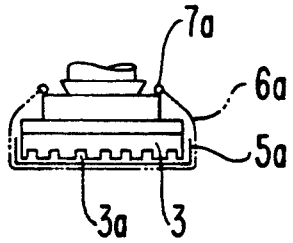
FIG. 10(b) (PRIOR ART)
Figure 10C:
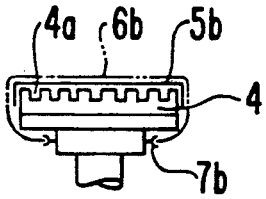
FIG. 10(c) (PRIOR ART)
Figure 11:
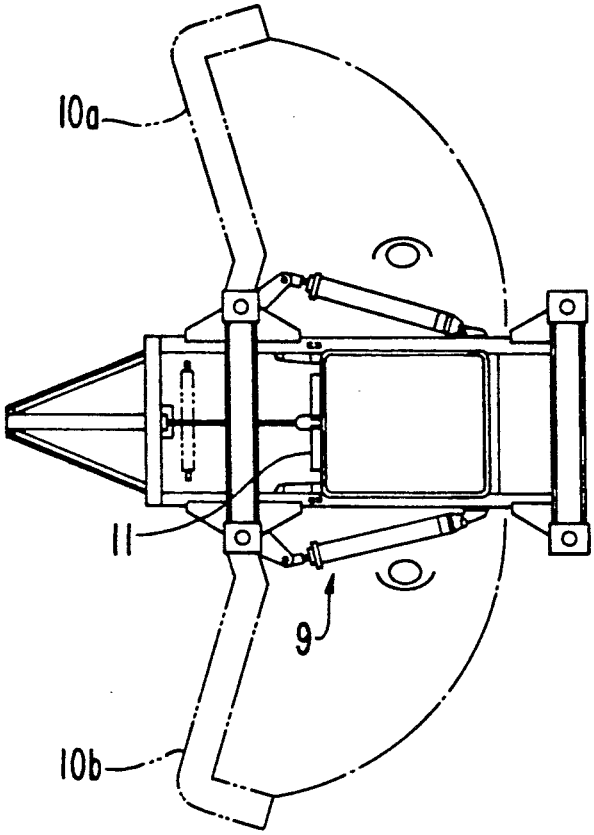
FIG. 11 (PRIOR ART)
FIG. 11 is a cross-sectional view taken along line 11—11 in FIG. 10(*a*)

As shown in FIG. 8, the lower wrapping material 6*b* is drawn out from a wrapping material roll 68 by a drawing device 69. And, after it has been cut into a length sufficient for one package, it is automatically fed to the lower wrapping device 63 by a lower wrapping material feeding device 70. On the other hand, the upper wrapping material 6*a* is drawn out from a wrapping material roll 71 by an upper wrapping material feeding device 72. And after it has been cut into a length sufficient for one package, it is fed to the upper wrapping device 62. The upper wrapping device 62 folds the upper reinforcement 5*a* and the upper wrapping material 6*a* upwards as shown in FIG. 5 in preparation for compressing the tow within the self-traveling type compression box 56.

Figure 5:
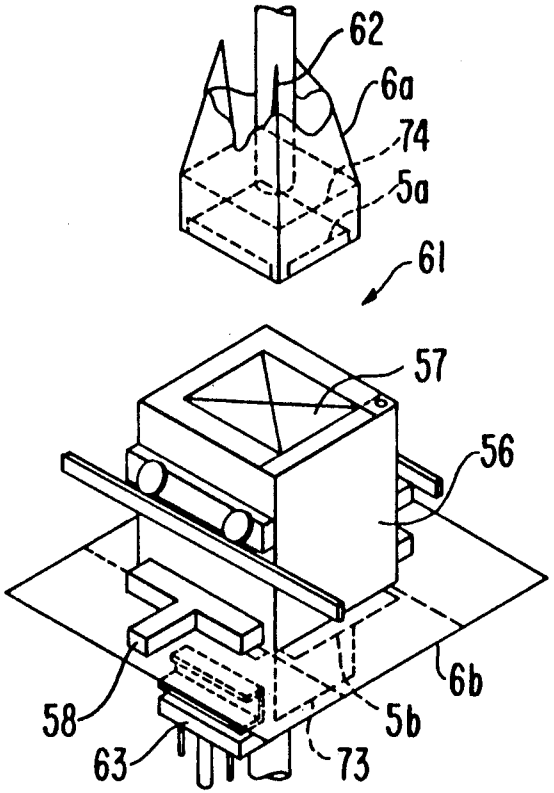
FIG. 5 i a perspective view of that portion of the apparatus intersected by line 5—5 in FIG. 3.

FIG. 5 shows the state where the self-traveling type compression box 56 has come into the main compression device 61 and the upper and lower reinforcements 5*a* and 5*b* and the upper and lower wrapping materials 6*a* and 6*b* have been fed to the main compression device 61. Starting from the state shown in FIG. 5, the lower wrapping device 63 is raised by a hydraulic cylinder or the like until the lower wrapping material 6*b* closes the bottom of the self-traveling type compression box 56.

Figure 21A:
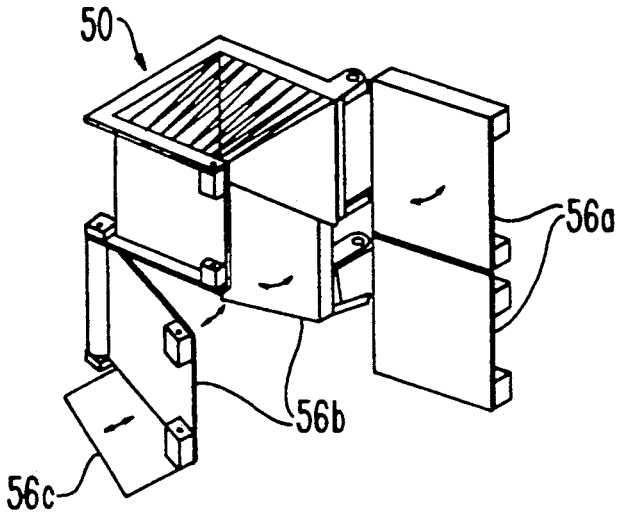
FIGS. 21(*a*)-21(*b*) are perspective detailed views of a self-traveling type of compression box.
Figure 21B:
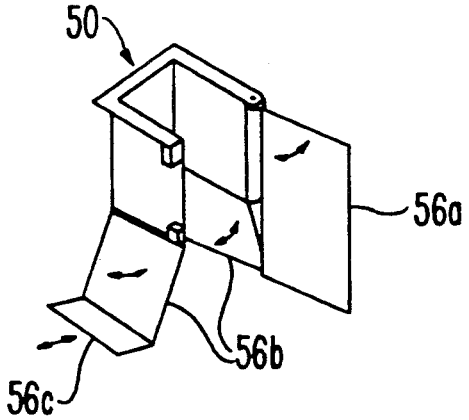

Next, the tow receiver 58 at the bottom of the self-traveling type compression box 56 is opened, and the tow is supported by the upper surface of a receiving seat 73 via the lower wrapping material 6*b* and the lower reinforcement 5*b*. Thus receiving seat 73 forms one constituent element of the lower wrapping device 63. Under this condition, an upper press seat 74, which forms one constituent element of the upper wrapping device 62, descends jointly with the upper reinforcement 5*a* and the upper wrapping material 6*a*, and compressively shapes the tow 57 within the self-traveling type compression box 56 with a predetermined compressing force until the tow exhibits a predetermined height. Thereafter, doors of the self-traveling type compression box 56 are automatically opened, and the self-traveling type compression box 56 travels by itself from the center of the main compression device 61 to its original state at the preliminary compression and tow transfer machine 52. Specifically, as shown in FIGS. 21(*a*) and 21(*b*), the compression box 56 is provided with a front door 56*a*, side doors 56*b* and bottom doors 56*c*. The bottom doors 56*c* can be moved horizontally with respect to the side doors 56*b*. The front door 56*a* and the side doors 56*b* are swingable about respective hinges thereof. When these doors are opened as shown in FIGS. 21(*a*) and 21(*b*), the tow in the compression box 56 can be removed. Each of these doors is moved by an actuator (fluid cylinder) not shown. It should be noted that the actuation of doors of this kind is widely known.

After the main compression of the tow is completed, the resulting tow block is automatically wrapped by the lower wrapping device 63 and the upper wrapping device 62. Starting from the state shown in FIG. 6, first the lower portion of the tow block is wrapped and then the upper portion of the tow block is wrapped in the manner shown in FIGS. 1(*b*) and 1(*c*). It is to be noted that the wrapping sequence in the illustrated embodiment could be alternatively carried out as in the prior art method in which the upper portion and then the lower portion of the tow block is wrapped. After a tow block has been wrapped with the wrapping materials, ears 74*a*, 74*b*, 75*a* and 75*b* of the upper and lower reinforcements 5*a* and 5*b* are folded in the illustrated manner by the upper wrapping device 62 and the lower wrapping device 63. It is to be noted that these ears serve to prevent the bundling belts 20 such as bands, wires or the like from biting into the reinforcements.

Now, the above-described method and apparatus for feeding the reinforcements and wrapping material, and for wrapping the article therewith will be described in greater detail referring first to FIGS. 22–25 (reinforcement feeding) and then to FIGS. 26–28 (wrapping).

Figure 22:
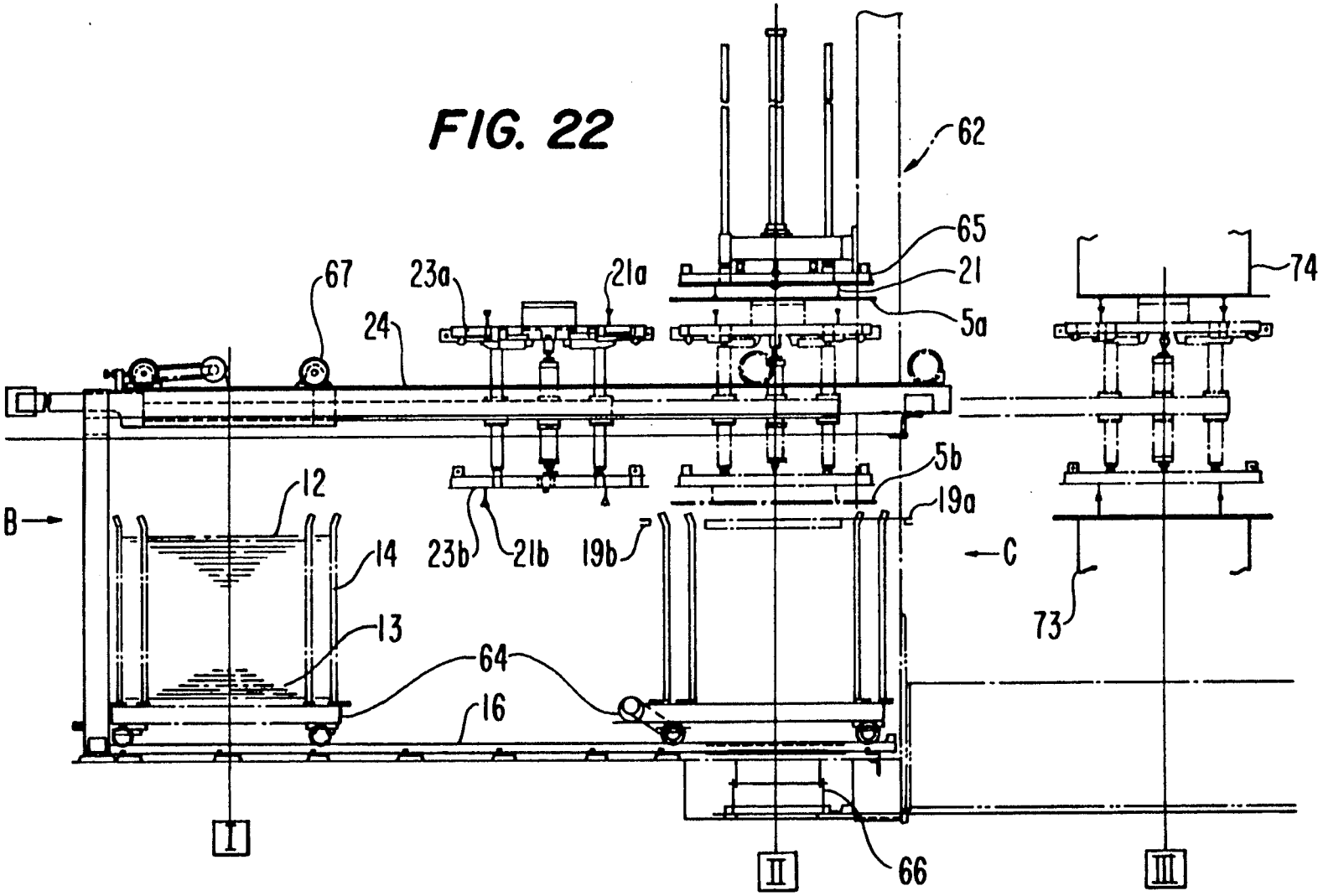
FIG. 22 is a detailed diagram of that part of the apparatus of the present invention shown in FIG. 7 for feeding reinforcements to the article to be packed.
Figure 23:
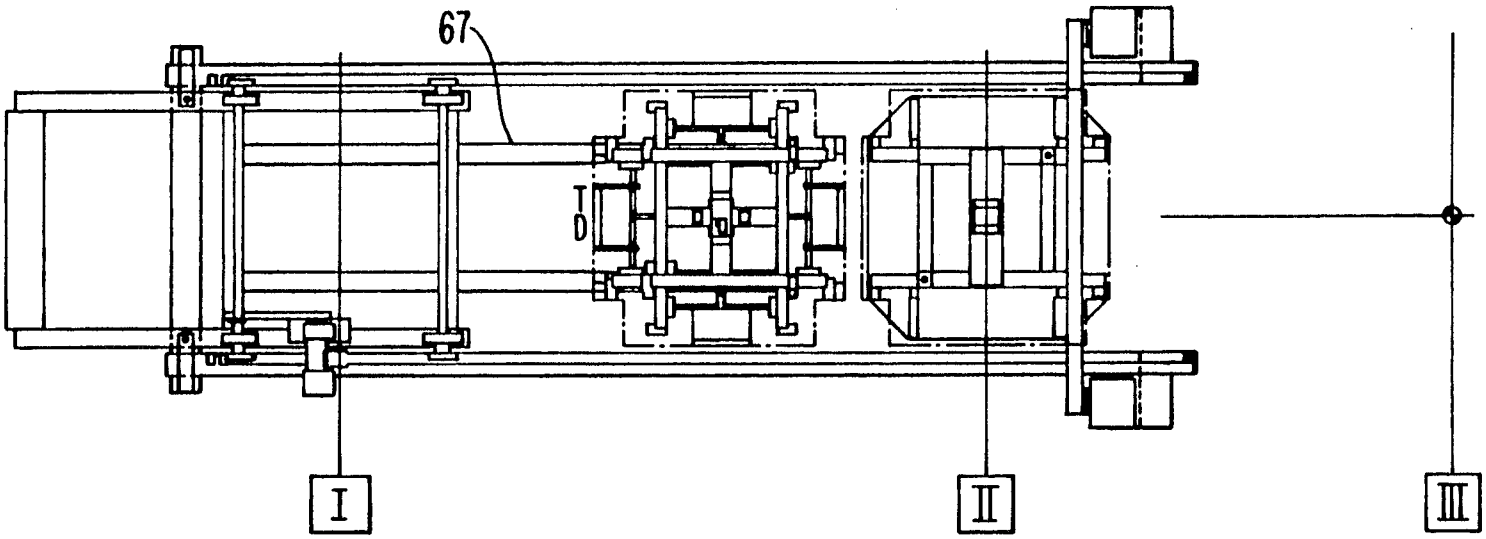
FIG. 23 is a plan view of the same.
Figure 24:
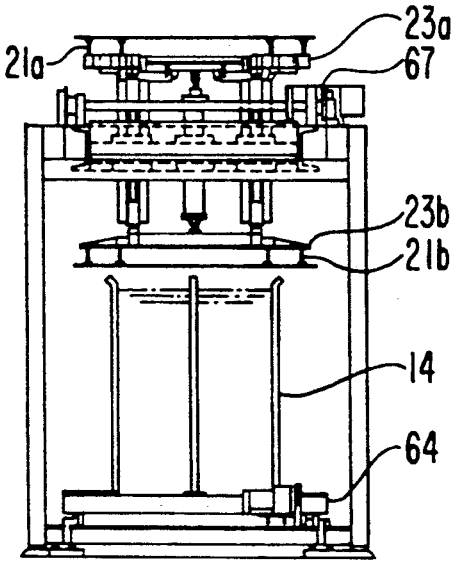
FIG. 24 is a view taken in the direction of arrow B in FIG. 22.
Figure 25:
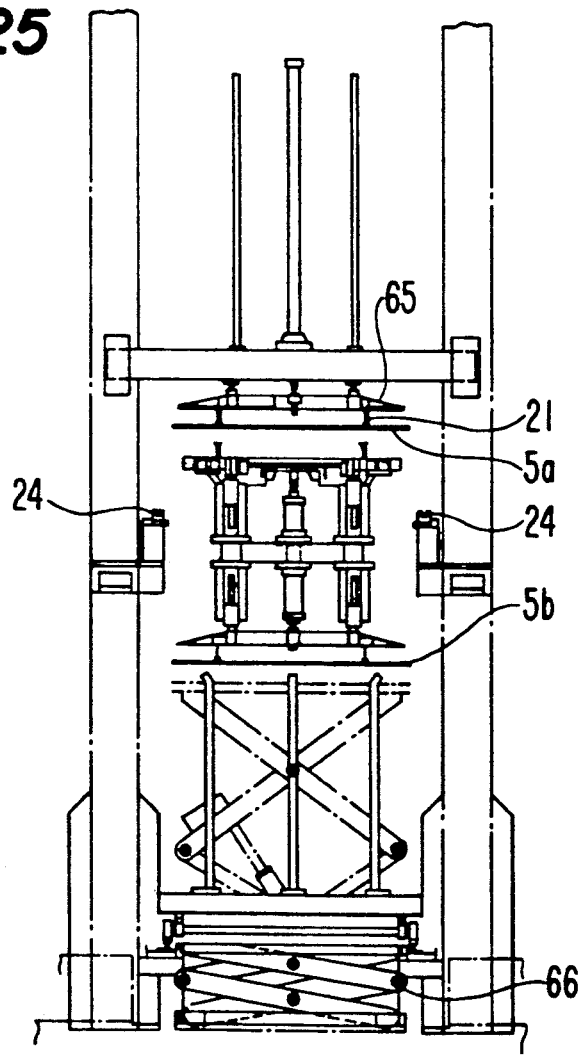
FIG. 25 is a view taken in the direction of arrow C in FIG. 22.

In FIGS. 22 and 23, at position [I] the reinforcing material stocker 64 is manually loaded with reinforcements. At position [II], the same stocker 64 is fixed and the reinforcements are picked therefrom by the reinforcement lifting device 65 and a reinforcement feed truck 67. At position [III] the wrapping devices 62, 63 are charged with the reinforcing material.

The reinforcing material stocker 64 has a truck frame which is hollow at its central portion so that the reinforcement elevator 66 can be raised therethrough to lift the pile of reinforcements stacked on the stocker 64.

A vertical reinforcing material bed 13 is interposed between the frame of the stocker 64 and the reinforcements. This material bed 13 is made of a veneer board or the like for supporting the reinforcements on the stocker 64, particularly when the reinforcements are lifted from the stocker 64 by the elevating device 66.

Numeral 14 designates a guide which is used at position [I] in the manual loading of the stocker with the reinforcements and at position [II] to guide the same reinforcements up to a predetermined level when the material bed 13 is lifted by the elevating device 66.

When the stocker 64 is manually loaded completely with a predetermined amount of reinforcements, a start button (not shown) of the stocker 64 is pushed by the operator. In response, the stocker 64 runs by itself on rails 16 until it automatically stops at position [II]. The stocker 64 remains at this position until the reinforcements are used up by the main compression device 62 or have been reduced to a predetermined number.

The transfer of the reinforcements will now be described.

First of all, the reinforcements on the stocker 64 are lifted via the reinforcing material bed 13 by the reinforcement elevator 66 to a level (i.e., an upper position) at which the upper end of the pile of reinforcements is detected by sensors 19*a* and 19*b*, such as photoelectric switches. Next, the reinforcement lifting device 6 is lowered to the level of the top of the pile of reinforcements by a vertical drive means such as an air cylinder. Reinforcing material transfer means such as vacuum suction pads 21 are attached to the bottom of the reinforcement lifting device 65 so that the reinforcement at the top of the pile thereof is sucked to the reinforcement lifting device 65.

After this, the reinforcement lifting device 65 ascends to the position shown in FIG. 22 at which position it stands by while holding the reinforcement 5*a*. The reinforcement elevator 66 also stands by in the aforementioned upper position. In this state, the reinforcement feed truck 67 travels along rails 24 until it arrives at position [II]. This reinforcement feed truck 67 is equipped with two sets of vertically displacable carriages 23*a* and 23*b*. At position [II], the upper carriage 23*a* is moved upward by a vertical drive means such as an air cylinder, whereas the lower carriage 23*b* is moved downward by a vertical drive means such as an air cylinder. Both of these carriages 23*a* and 23*b* are provided with reinforcing material transfer means such as vacuum suction pads 21*a* and 21*b*. The lower carriage 23*b* ascends after it has received one reinforcement at the upper end of the pile whereas the upper carriage 21*b* descends after it has received the reinforcement held by the transfer means 21 of the reinforcement lifting device 65.

Next, as the press seat 74 of the upper wrapping device and the receiving seat 73 of the lower wrapping device 63 of the main compression device 61 assumes the state shown in FIG. 22, the reinforcement feed truck 67 accordingly travels by itself on the rails 24 from position [II] to the position [III] while holding the aforementioned reinforcements.

At position [III], the upper carriage 23*a* ascends whereas the lower carriage 23*b* descends, to push the so held individual reinforcements to the press seat 73 and the receiving seat 74 of the wrapping devices of the main compression device. The aforementioned seats are also provided with reinforcing material receiving and holding mechanisms (not shown) such as vacuum suction pads for receiving the reinforcement from the reinforcement feed truck 67.

After the individual reinforcements have been transferred, the upper carriage 23*a* ascends whereas the lower carriage 23*b* descends. Then, the reinforcement feed truck runs by itself on rails 24 from position [III] to the position [I].

All of the operations thus far described automatically continue to feed the reinforcements to the main compression device until a "no reinforcing material warning" is issued at the reinforcement elevator 66.

Specifically, when the reinforcements on the reinforcement elevator 66 have been used up (or a predetermined number remain thereon), sensors attached to the reinforcement elevator 66 issue a warning, and the reinforcement elevator descends to its lower limit (i.e., the position indicated by solid lines). After this descent, the stocker 64 automatically moves from position [II] to the position [I]. The stocker 64 is manually loaded again with the reinforcements at position [I].

Figure 26:
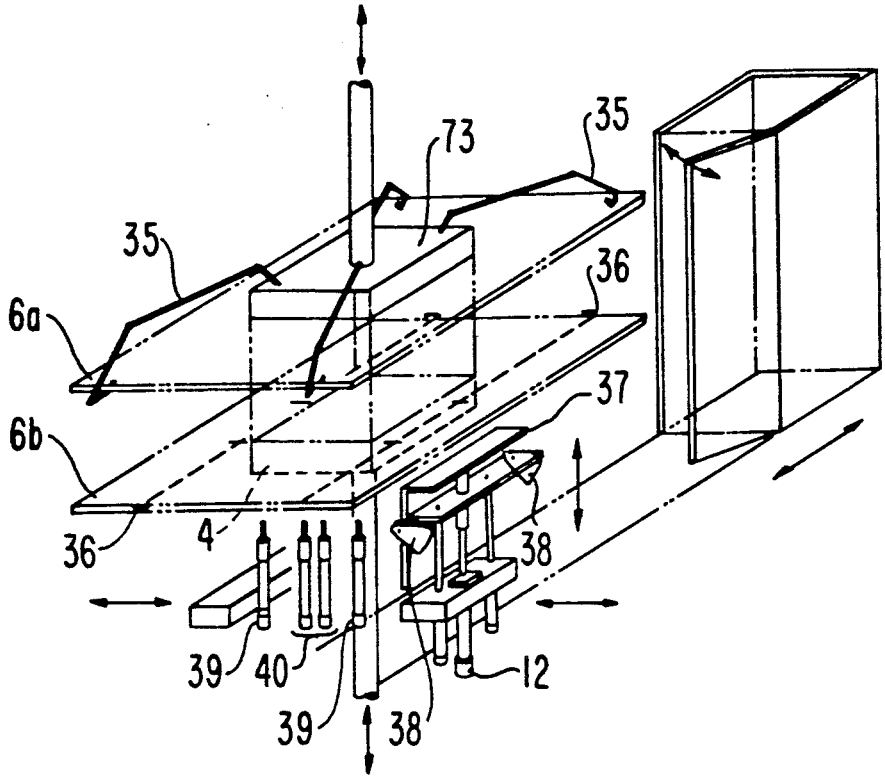
FIG. 26 is a detailed diagram of the wrapping device of the apparatus of the present invention shown in FIG. 8 for wrapping the article to be packed.
Figure 27A:
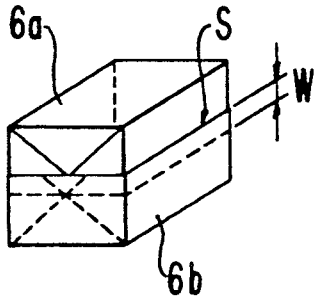
FIGS. 27(*a*) and 27(*b*) are schematic diagrams showing one state in which an article can be wrapped, and FIGS. 27(*c*) and 27(*d*) are schematic diagrams shown an alternative state in which an article can be wrapped.
Figure 27C:
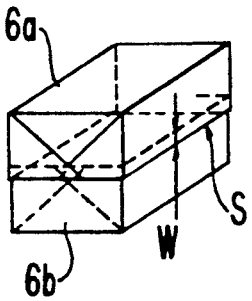
Figure 27B:
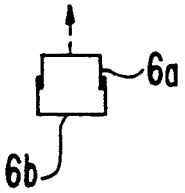
Figure 27D:
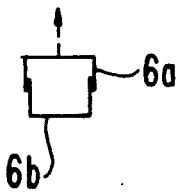
Figure 28A:
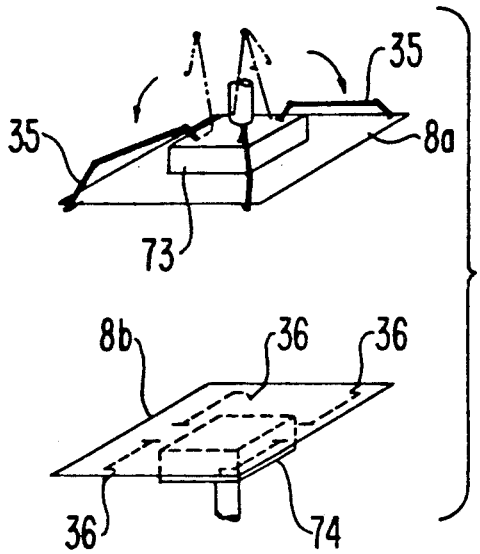
FIGS. 28(*a*)-28(*o*) are perspective views illustrating the successive steps carried out by the wrapping device shown in FIG. 26.
Figure 28B:
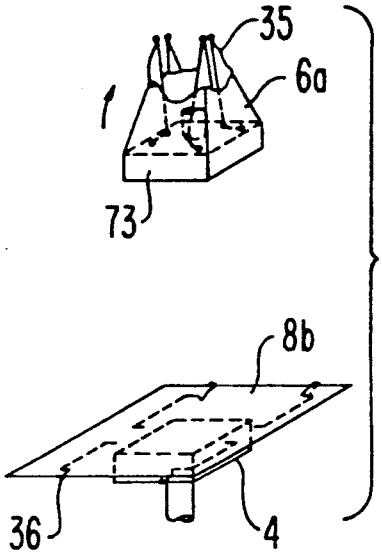
Figure 28C:
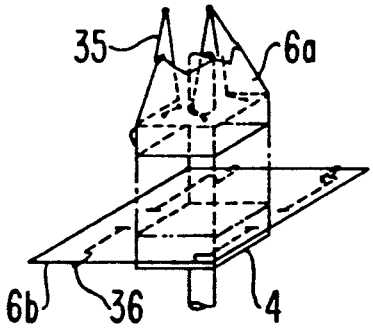
Figure 28D:
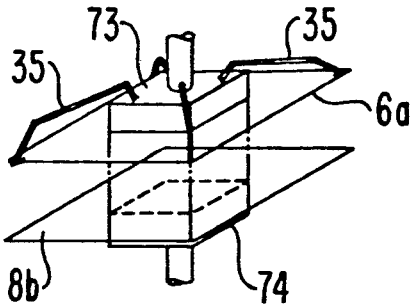
Figure 28E:
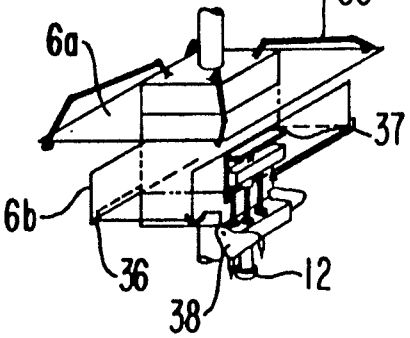
Figure 28F:
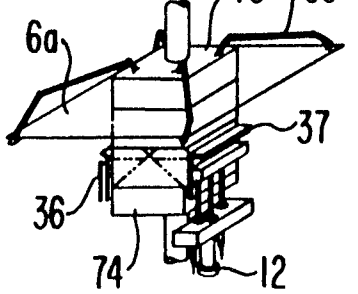
Figure 28G:
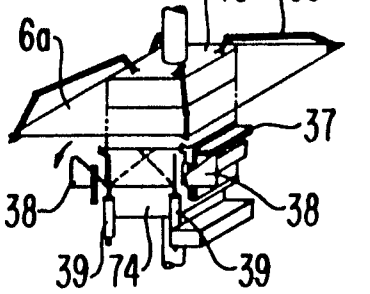
Figure 28H:
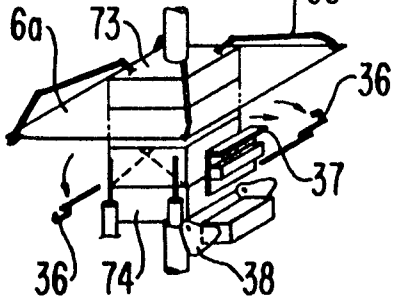
Figure 28I:
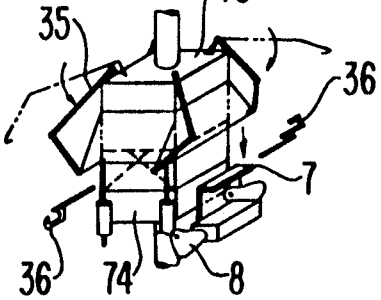
Figure 28J:
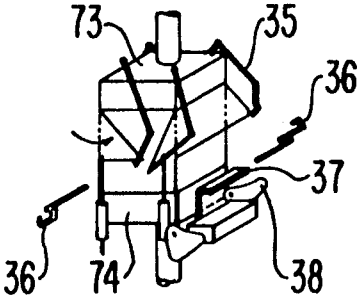
Figure 28K:
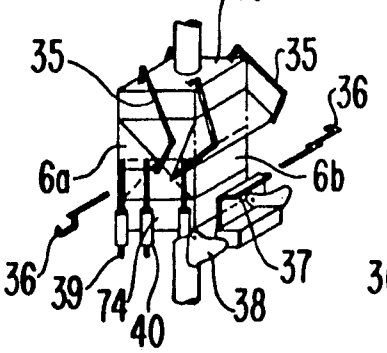
Figure 28L:
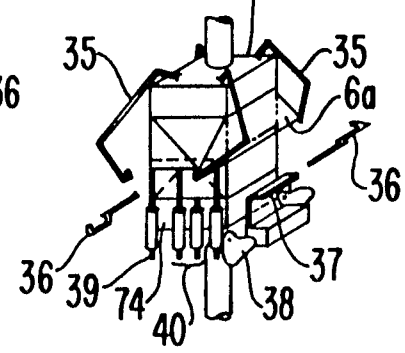
Figure 28M:
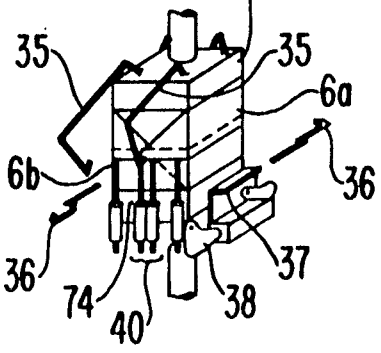
Figure 28N:
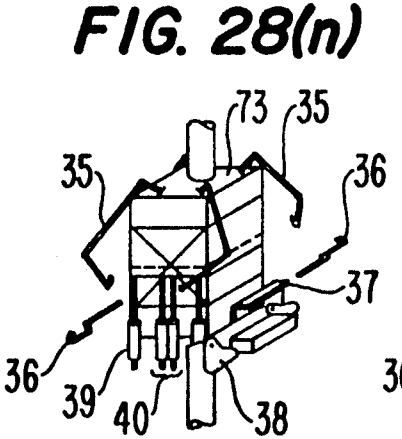
Figure 28O:
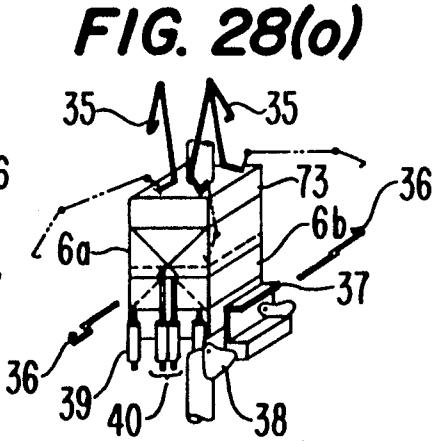

FIG. 26 is a perspective partial view of an embodiment of a main compression device in the automatic packaging apparatus according to the present invention, and is particularly adapted to the case in which tow (e.g., bundles of chemical fibers such as rayon or cut cotton fibers) is to be packaged. In this device, a series of working steps, namely, the compressing, wrapping and binding of the tow in a compressed state is carried out.

In either of the alternative wrapping modes shown in FIGS. 27(*a*) through 27(*d*), two pieces of wrapping material (e.g., Hessian cloth) 6*a* and 6*b* are used to cover the upper and lower faces of the article to be packed. The upper and lower packaging materials 6*a* and 6*b* are overlapped at W to ensure that the surfaces of the article are wrapped completely.

The structure and operation of the apparatus for forming the aforementioned package will be described in the following.

The wrapping devices 62, 63 of the main compression packaging device 61, equipped with the upper press seat 73 and the receiving seat 74, are vertically movable up and down by means of a well-known hydraulic cylinder. The press seat 73 is in turn equipped with four packaging inserting arms 35, and the receiving seat 74 is likewise equipped with four packaging folding arms 36. These two sets of arms 35 and 36 are provided at their leading ends with pawls for holding the edges of the sheets of wrapping material 6*a*, 6*b*. The inserting arms 35 can move their pawls three-dimensionally (i.e., stereoscopically), that is, forward and backward, rightward and leftward, and upward and downward. On the other hand, the folding arms 36 can move their pawls upward and downward. These actions are controlled by means of a servo-motor.

Auxiliary devices for packaging the article include a pair of righthand and lefthand side plates 37, lift means and horizontal traverse means for lifting and horizontally displacing the side plates 7, four sheet margin folding plates 38 adapted to move up and down at the four corners of the article and to pivot about one point, respectively, and lower and upper sheet end holders 39 and 40 arranged to face the folded sheet portions.

The operation of the apparatus having the structure described above will now be explained with reference to FIGS. 28(*a*)–28(*o*).

First of all, when the wrapping material (e.g., the Hessian cloth) 6*a* is carried in by the upper wrapping material feeding device 72, the upper packaging inserting arms 35 attached to the press seat 73 are moved, as shown in FIG. 28(*a*), from the positions indicated by single-dotted lines to the neutral positions indicated by solid lines. The pawls of the inserting arms 35 thus receive the wrapping material 6*a*. Simultaneously, the lower wrapping material (e.g., the Hessian cloth) carried in by the lower wrapping material feeding device 70 is held without fail by the pawls at the leading ends of the lower packaging folding arms 36.

Next, as shown in FIG. 28(*b*), the four corners of the wrapping material (e.g., the Hessian cloth) 6*a* held by the upper packaging inserting arms 35 are folded upward. As should be clear from the previous description, this operation is in preparation for compressing the article.

In this state, the self-traveling-type compression box 56 moves forward to a predetermined position between the press seat 73 and the receiving seat 74. The receiving seat 74 is lifted to a standby position at the lower end of the compression box. After this, the tow receiver 58 at the bottom of the compression box 56 is retracted to release the lower end of the article, and the upper press seat 73 is moved down to compress the article in the compression box 56 against the receiving seat 74. After this, one side of the compression box 56 is opened, and the compression box 56 is retracted while freeing the article until it is returned to and held at the initial standby position.

The article 1 thus actually compressed has a box shape, as indicated by single-dotted lines in FIG. 28(*c*).

Next, as shown in FIG. 28(*d*), the upper packaging material (i.e., the Hessian cloth) 6*a* is horizontally extended, and the lower two side plates 37 are lifted by cylinder 12, as shown in FIG. 28(*e*). After this, the lower folding arms 36 are lifted as shown in FIG. 28(*f*) and the margin folding plates 38 are pivoted so as to fold the opposed marginal corner portions of the wrapping material 6*b* at right angles toward one another thereby wrapping the bottom of the article 1.

Next, as shown in FIG. 28(*g*), the margin folding plates 38 are pivoted outward, and the lower sheet end holders 39 are actuated to press and hold the wrapping material 6*b* against the ends of the article.

After this, as shown in FIG. 28(*h*), the packaging folding arms 36 are horizontally returned, and the two side plates 37 are horizontally displaced away from the article.

Next, as shown in FIG. 28(*i*), the side plates 37 are lowered to allow the leading ends of the upper packaging inserting arms 35 to be moved to their lower limit positions.

Subsequently, as shown in FIG. 28(*j*), the aforementioned packaging folding arms 35 fold the corners at one side of the upper wrapping material 6*a* inward. After this, as shown in FIG. 28(*k*), one of the upper sheet end holders 40 is actuated to hold the folded ends of the upper wrapping material 6*a*. Next, as shown in FIG. 28(*l*), those pawls at the leading ends of the upper packaging inserting arms 35 holding the folded corners are opened to release the sheet, and these arms 35 are returned to their original positions (as indicated by the solid lines) After this, as shown in FIG. 28(*m*), the other upper packaging inserting arms 35 are actuated to similarly fold the corners at the other side of the wrapping material 6*a*. Subsequently, the other upper sheet end holder 40 is actuated to hold these folded ends of the wrapping material 6*a*.

Next, as shown in FIG. 28(*n*), the pawls of these packaging inserting arms 35 are opened and the arms are restored to their initial folded positions.

Finally, as shown in FIG. 28(*o*), the lower sheet end holders 39 are lowered, and the upper packaging inserting arms 35 are moved to the neutral positions indicated by the single-dotted lines and then to the upper limit positions, at which upper limit positions they are held in a standby state as indicated by the solid lines.

Next, the feeding of the side surface reinforcements 19*a* and 19*b* to the side surfaces of the tow block and the bundling of the tow block with bundling belts 2 will be described.

In FIG. 3, a sufficient number of side surface reinforcements 19*a* and 19*b* are stacked in stockers 76*a* and 76*b*, respectively. The reinforcements are automatically fed one-by-one by reinforcement feeding devices 77*a* and 77*b* to a band (or wire) applying device 78 when the band applying device 78 is at a home position or standby position 78H, and to a band (or wire) guiding device 79 when the band guiding device 79 is at a home position or standby position 79H. After the ears of the upper and lower wrapping materials 6*a* and 6*b* and of the upper and lower reinforcements 5*a* and 5*b* have been folded towards the tow block, the band (or wire) applying device 78 and the band (or wire) guiding device 79 move automatically to the solid-line positions shown in FIGS. 3 and 8. At these positions, the band applying devices urge the side surface reinforcements 19*a* and 19*b* toward the center of the main compression device 61 and against the side surfaces of the tow block in the manner shown in FIG. 1(*e*).

Thereafter, the band (or wire) applying device 78 bundles the tow block with bundling belts 20 in the known manner shown in FIG. 1(*f*) using the band (or wire) guides provided within the upper press seat 74 and the receiving seat 73. When this bundling has been completed, the band (or wire) applying device 78 returns to its standby position 78H shown in FIG. 3.

A bale take-out conveyor 80 is interlocked with the band (or wire) applying device 78. Accordingly, when the band (or wire) applying device 78 assumes the standby position 78H, the conveyor 80 connects the preliminary compression and tow transfer device 52 with the center of the main compression device 61. In addition, the band (or wire) guiding device 79 is associated with a bale push-out machine 81.

The upper press seat 74 of the upper wrapping device 62 releases the compressing force applied to the tow block after the above-described bundling operation. In this respect the press seat is raised in preparation for the removal of the tow block from the main compression device 6 and onto the bale take-out conveyor 80.

When the above-mentioned operation has been completed, the bale take-out conveyor 80 advances towards the main compression device 61 in order to receive the bale. Subsequently, the packed bale is pushed out onto the bale take-out conveyor 80 by the bale push-out machine 81.

Thereafter, the packed bale is conveyed to the bundling machine 84, via the bale take-out conveyor 80, a transverser 82 and a bale transport conveyor 83. End surface reinforcements 21*a* and 21*b* have been preliminarily fed to the bundling machine 84 from end surface reinforcement stockers 85*a* and 85*b* by reinforcement feeding devices 86*a* and 86*b*, respectively. When the packed bale has been conveyed to the bundling machine 84, the bale is positioned thereat by a bale positioning device (not shown). Subsequently, end surface reinforcements 21*a* and 21*b* are applied to the end surfaces 87*a* and 87*b* of the bale. Next, bands (or wires) 88 are applied to the bale by the bundling machine, whereby the end surface reinforcements 21*a* and 21*b* are fixed to the bale end surfaces 87*a* and 87*b* and the expansion of the bale is constrained. It is to be noted that the ears of the upper and lower reinforcements 5*a* and 5*b* of the packed bale are folded by well-known folding guides and folding machines (not shown) midway during the transport of the bale by the bale transport conveyor 83. Specifically, the ears of the upper reinforcement 5*a* are folded downwards, while those of the lower reinforcement 5*b* are folded upwards. Thus, the ears do not become obstacles when the end surface reinforcements 21*a* and 21*b* are applied. In succession, the packed bale is conveyed by the bale transport conveyor 83 to a horizontal bundling device 89.

There, the ears 90*a*, 90*b* (FIG. 1(*b*)) at the opposite ends of each reinforcement 19*a* or 19*b* are folded by an ear folding device (not shown) provided in the horizontal bundling device 89. Subsequently, a bundling portion 91 of the bundling device 89 shown in FIG. 9 descends, and sequentially applies bands (or wires) 22 (FIG. 1(*i*)) around the ears 90*a* and 90*b* of the reinforcements 19*a* and 19*b* to confine the ears against the end surfaces of the packed bale.

With respect to the above-described bundling operation, the specific device for applying the bands (or wires) around the wrapping material and reinforcements may be that disclosed in Japanese Laid-Open Patent Appln. No. 271815/1987. Such a device will now be described with reference to FIGS. 29–42. It will be readily understood how this device is applied to the corresponding elements described above in connection with the present invention.

Figure 29:
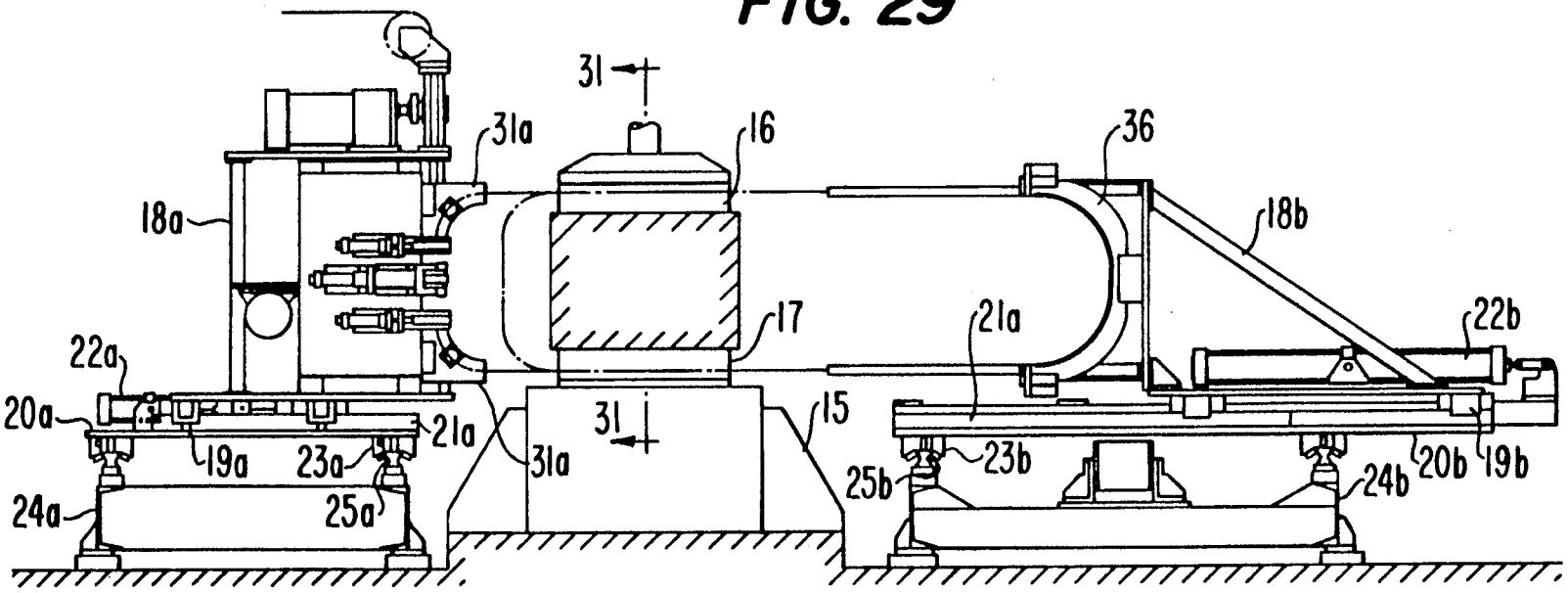
FIGS. 29-42 are detailed diagrams of a bundling apparatus which can be used by the present invention to bundle a wrapped article with wires or bands, FIG. 29 being a front elevation view of the apparatus, FIG. 30 being a top plan view of the same, FIG. 31 being a sectional view taken along line 31—31 of FIG. 29, FIG. 32A) being a top plan view of a wire feed device in the apparatus, FIG. 34(B) being a side elevation view of the same, FIGS. 33(A) and 35(A) being front elevation views showing the mounted state of the wire guide device, FIG. (33B) being a view of FIG. 33(A) taken in the direction of arrow B, FIG. 33(C) being a view of FIG. 33(A) taken in the direction of arrow C, FIG. 34(A) being a front elevation view of a cylindrical guide, FIG. 34(B) being a view of FIG. 34(A) taken in the direction of arrow G, FIG. 35(B) being a sectional view taken along line 35(*b*—35(*b*) of FIG. 35(A), FIG. 35(C) being a sectional view taken along line 35(*c*)—35(*c*) of FIG. 35(A), FIG. 35(D) being a sectional view taken along line 35(*d*)—35(*d*) of FIG. 35(A), FIG. 36 being a front elevation view showing the mounted state of a wire twisting device, FIG. 37(A) being a top plan view of the wire twisting device, FIG. 37(B) being a front elevation of the same, FIG. 38(A) being a front elevation view of a wire holding portion, FIG. 38(B) being a top plan view of the same, FIG. 39 being a front elevation view of a wire guide portion, FIG. 40(A) being a front elevation view of a corner roll portion, FIG. 40(B) being a side elevation view taken below the corner roll portion, FIG. 41 being a rear view of the apparatus showing the state in which the wire passes through the wire guide groove, and FIG. 42 being an explanatory diagram for illustrating a series of wiring twisting steps.
Figure 30:
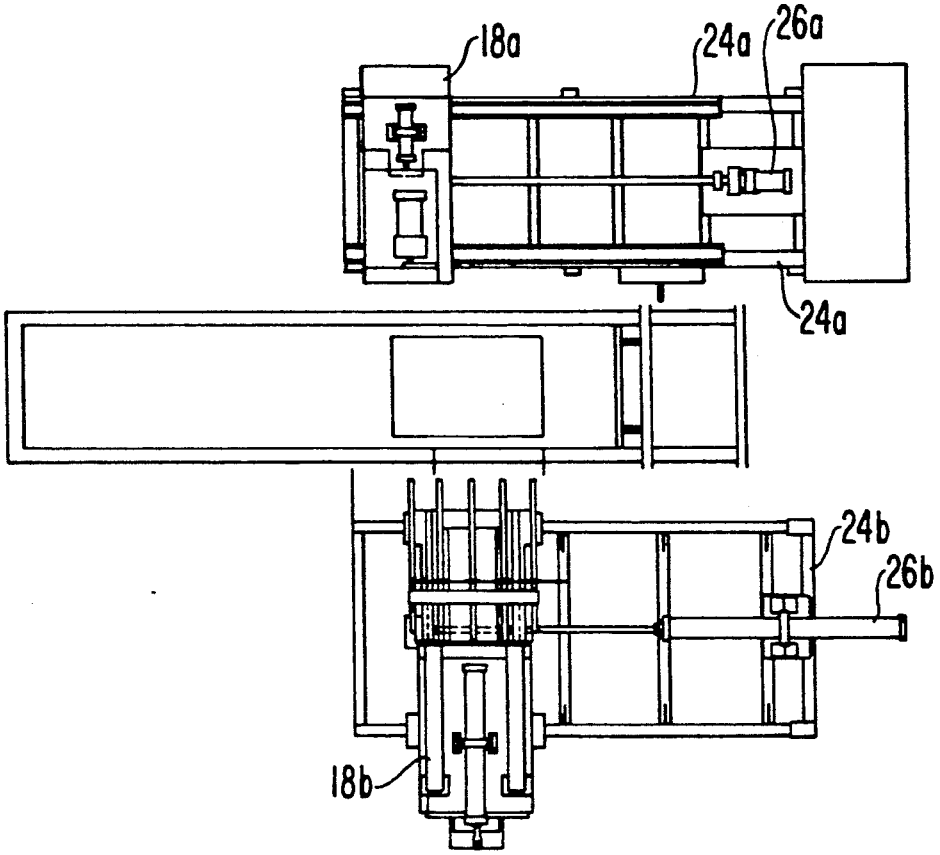
Figure 31:
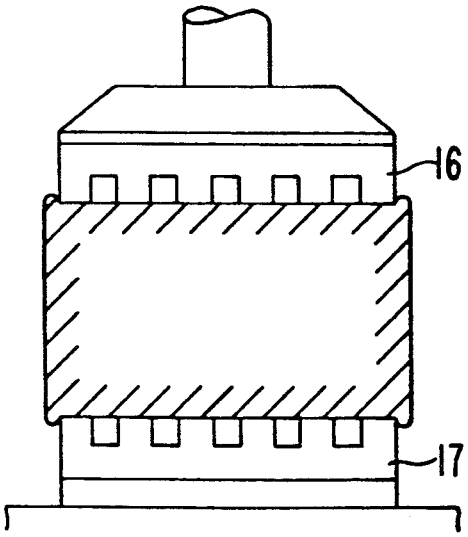

In FIGS. 29 and 30, reference numeral 15 designates the body of a compression packing machine, which includes a preliminary compression apparatus, a main compression apparatus and a compression box. A main compression press plate 16 and a press bed plate 17 have grooves therein (FIG. 31) corresponding in number to the number of bands or wires to be bundled around the article.

Numerals 18*a* and 18*b* designate trucks for supporting a wire feed apparatus and wire guide apparatus. The trucks 18*a* and 18*b* are arranged to run on the rails 21*a* and 21*b* of bed plates 20*a* and 20*b* through wheels 19*a* and 19*b*. Cylinders 22*a* and 22*b* are attached to bed plates 20*a* and 20*b*. These cylinders have their leading ends connected to the trucks 18*a* and 18*b*. Moreover, the bed plates 20*a* and 20*b* are arranged to run on rails 25*a* and 25*b* of frames 24*a* and 24*b* through wheels 23*a* and 23*b* and are connected to cylinders 26*a* and 26*b*.

Figure 32A:
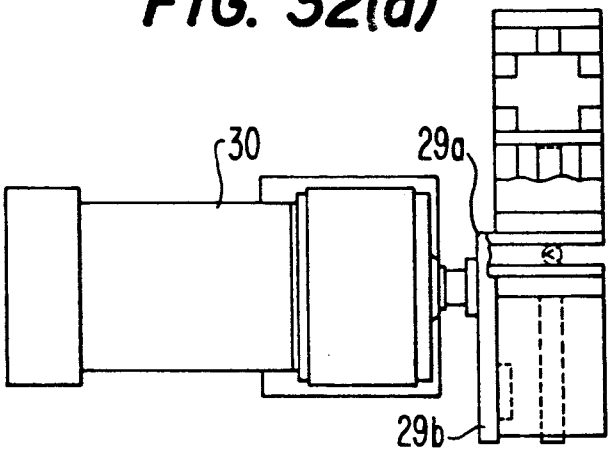
Figure 32B:
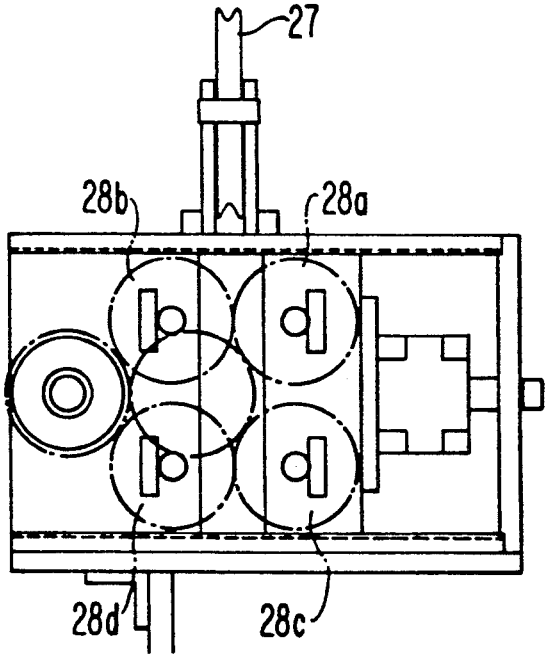

FIGS. 32(*a*) and 32(*b*) show a wire feed mechanism, which includes a wire guide reel 27, feed gears 28*a* to 28*d* and transmission gears 29*a* and 29*b*, driven by a reversible drive mechanism 30. Incidentally, the feed gears 28*a* to 28*d* are grooved in accordance with the wire diameters.

Figure 33A:
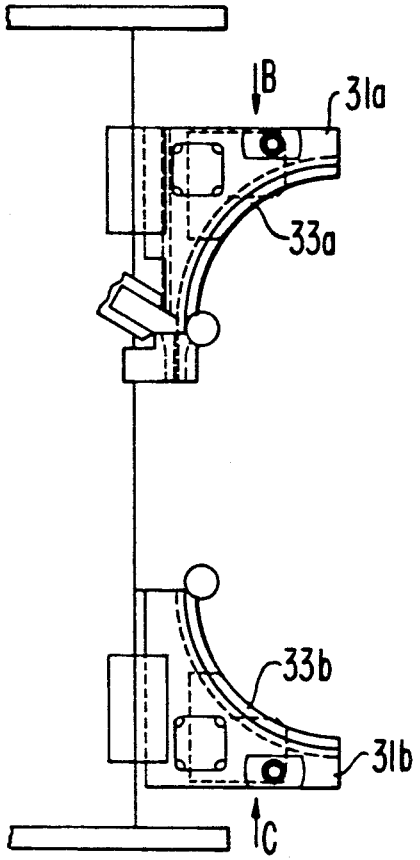
Figure 33B:
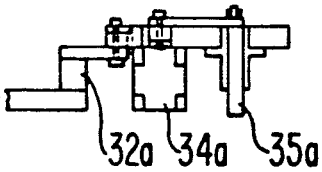
Figure 33C:
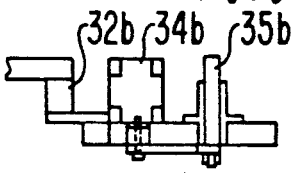

FIG. 33 shows a corner guide which is attached to the truck 18*a* through brackets 32*a* and 32*b*. The corner guides 31*a* and 31*b* are partially grooved to allow the wires to pass therethrough. Specifically, the upper corner guide 31*a* is formed with two grooves. Covers 33*a*, 33*b* are arranged along the curved portions of the corner guides. These covers 33*a* and 33*b* are caused to slide by built-in cylinders 34*a* and 34*b* and guides 35*a* and 35*b*.

In FIG. 35, reference numeral 36 designates a reflection guide which is attached to the truck 18*b* through a bracket 37 the reflection guide 36 is also grooved like the corner guide 31 for allowing the wires to pass therethrough and has, along its curved portion, a cover 40 which is slid by a cylinder 38 and a guide 39.

Figure 34A:
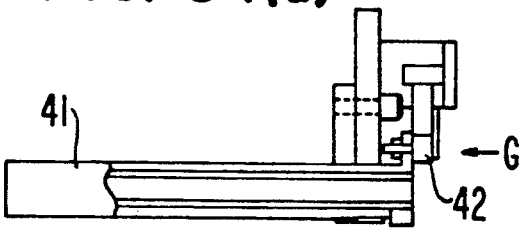
Figure 34B:
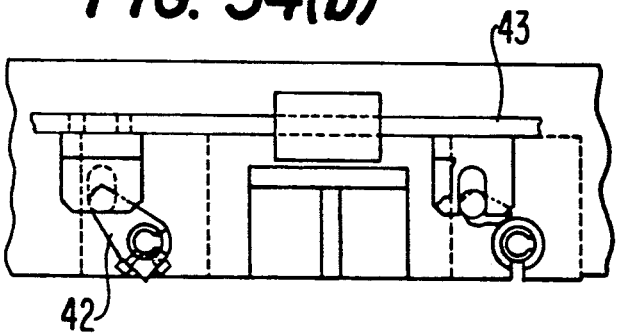
Figure 35A:
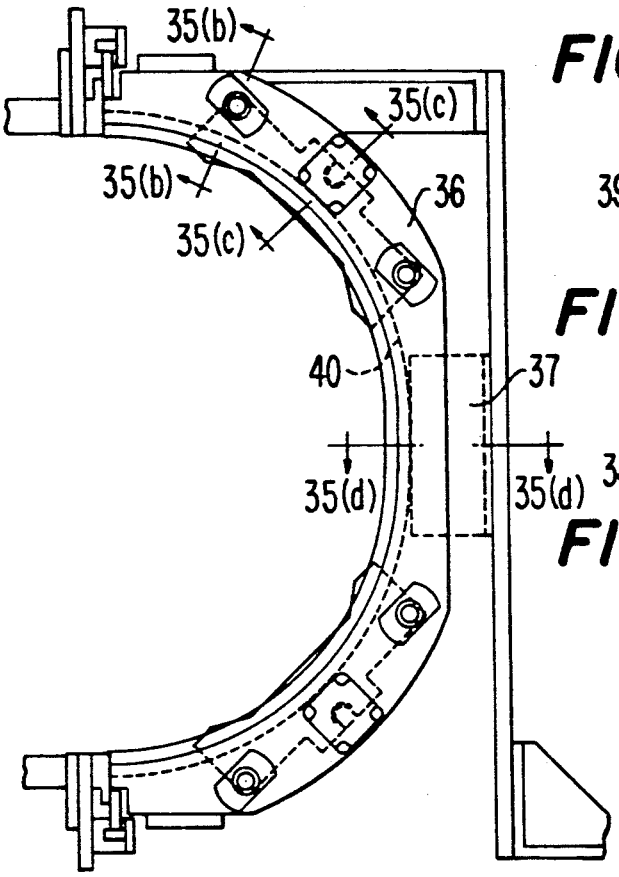
Figure 35B:
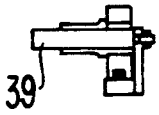
Figure 35C:
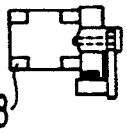
Figure 35D:
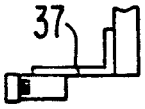

In FIG. 34, reference numeral 41 designates a cylindrical guide which comprises two split cylinders of partially removed pipes to form a pair of guides. The inner cylinder can be rotated by a slider 43 through a cam 42 which is arranged at its end portion.

Figure 36:
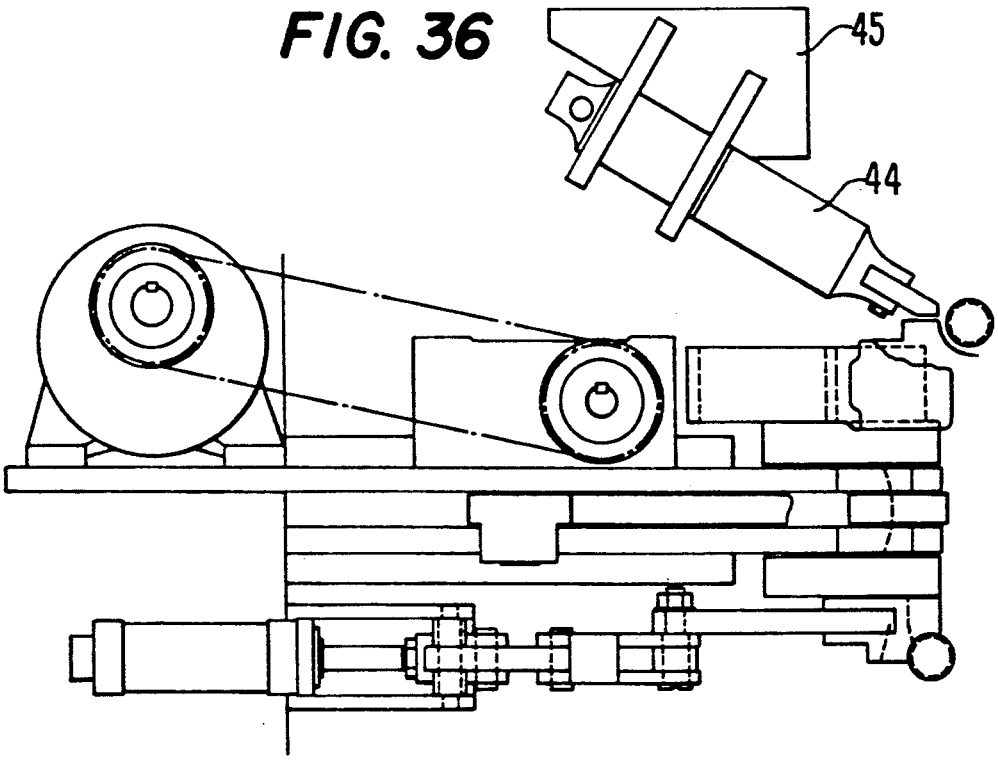

FIG. 36 shows a wire twisting apparatus comprising a wire twisting portion, a wire holding portion, a wire guide portion and a corner rolling portion, all of which are attached to the truck 18*a*. A cutter knife 44 is disposed over the twisting apparatus for cutting the wires. This cutter knife 44 is attached to the truck 18*a* through a bracket 45.

Figure 37A:
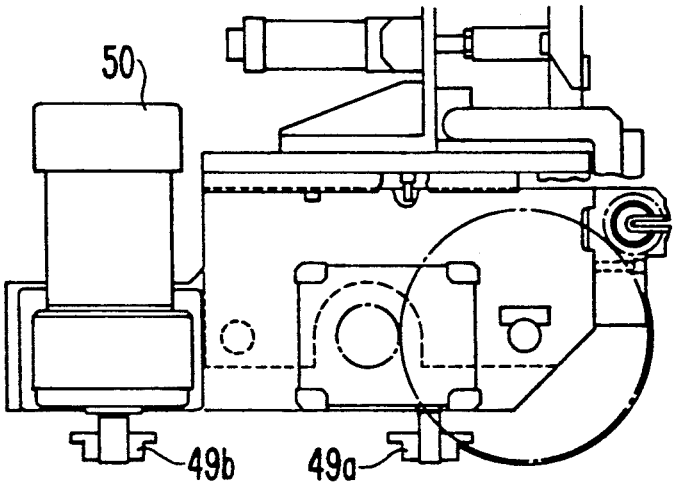
Figure 37B:
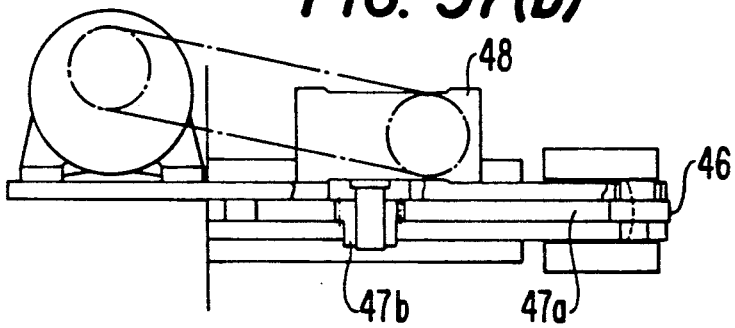

In FIG. 37, reference numeral 46 designates a torsion gear which is partially grooved so that it is opened in one direction, as shown. The torsion gear 46 can be rotated by a drive source 50 through drive gears 47*a* and 47*b*, a reduction gear mechanism 48 and sprocket wheels 49*a* and 49*b*.

Figure 38A:
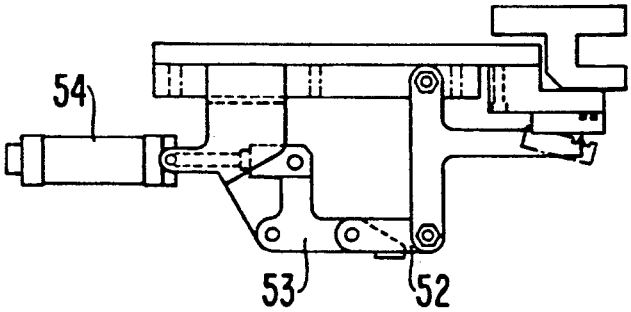
Figure 38B:
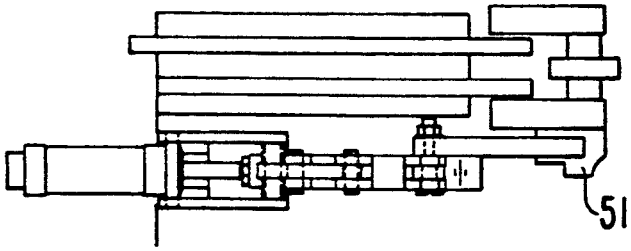

In FIG. 38, reference numeral 51 designates a wire holder which is formed with two grooves for allowing the wires to pass therethrough. The wire holder 51 can be actuated and released by a cylinder 54 through links 52 and 53.

Figure 39:
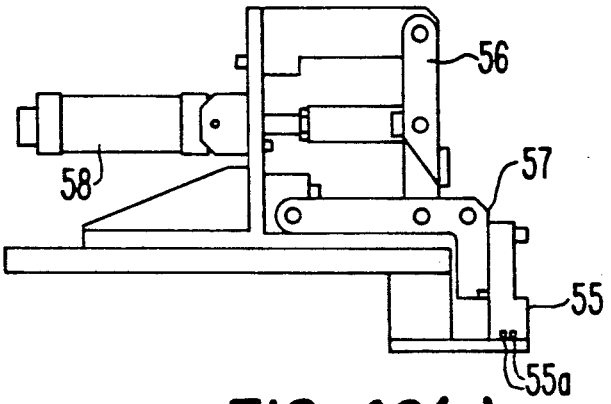

In FIG. 39, reference numeral 55 designates a wire guide which has two wire guide grooves 55*a*. The wire guide 55 can be actuated and released by a cylinder 58 through links 56 and 57.

Figure 40A:
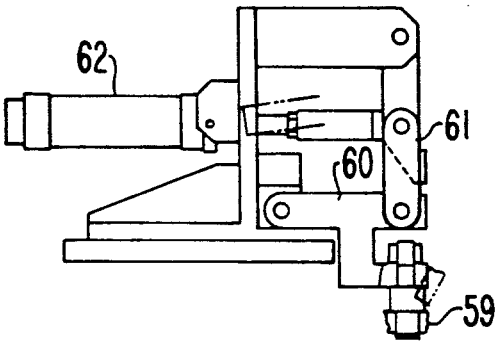
Figure 40B:
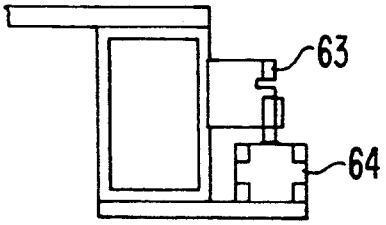
Figure 41:
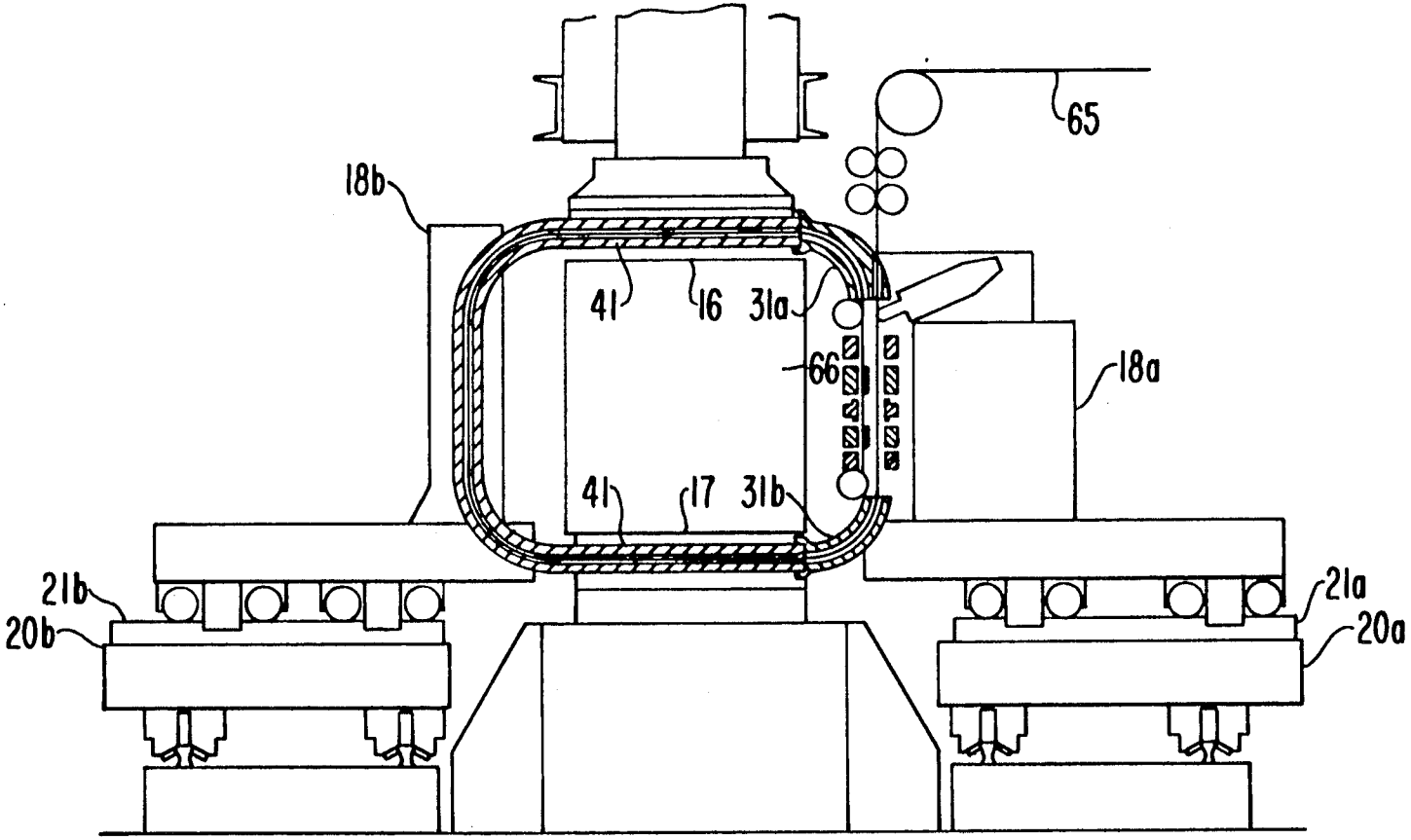

In FIG. 40, reference numeral 59 designates a corner roll which can be moved by a cylinder 62 through links 60 and 61. A guide 63 for clamping the end face of the wire when the wire is pulled is disposed below corner roll 59. A wire passing groove is formed in the guide 63 and can be partially opened and closed by a cylinder 64. When the individual members thus far described are operatively associated with one another an endless groove for allowing a wire 65 to pass therethrough is defined, as shown in FIG. 41, and two grooves are formed in the twisting apparatus.

Figure 42:
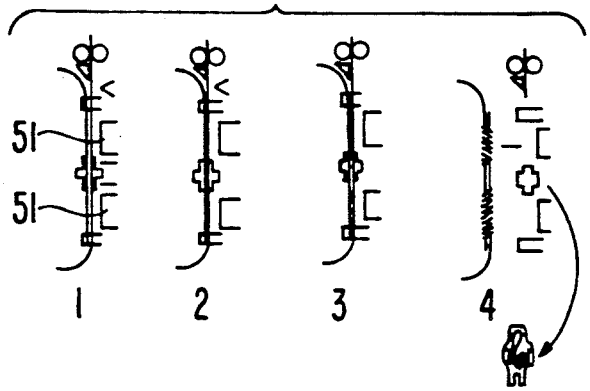

Next, the operation of the device for applying wire around the article (bundling) will be described. In FIG. 42, reference numeral 66 designates the article to be packed, which has been wrapped with a predetermined wrapping material after it has been intensely compressed by the packing machine. The trucks 18*a* and 18*b* move transversely and forward, so that the reflection guide 41 is inserted into the grooves of the press plate 16 and the plate bed plate 17 until its leading end is fitted in the corner guide 31. In this state, the wire feeding apparatus is actuated to feed the wire 65 into the guide groove, as shown in FIG. 41. Incidentally, the wire 65 is controlled to be automatically stopped when its leading end comes to a predetermined position.

Next, the pulling operation of the wire 65 will be described. In this operation, the wire 65 is extracted from the guide groove to thread it closely along the article. The wire 65 is brought out of the groove and is wound around the article by reversing the wire feed apparatus with the individual wire grooves being opened in one direction, as shown in FIGS. 33, 35 and 36. At this time, the wire 65 has its leading end clamped by the guide 63 so that it will not come out even if it is pulled.

The subsequent operations will be described with reference to FIG. 41. First of all, the wire holder 51 is released to establish a space for the wire twisting portion [(1)]. Next, the torsion gear 46 is turned to twist the wire for the bundling operation [(2)]. Next, the wire 65 is cut by the cutter knife 44 [(3)]. After this, the wire feed apparatus is retracted to extract the wire [(4)]. At this time, the corner roll 59 and the guide 63, as shown in FIG. 40, are to be conveniently relieved for facilitating the wire extraction. On the other hand, the torsion gear has its open groove directed in the wire extracting direction, as shown in FIG. 42.

Thus, the binding of one wire loop to the article is completed, and the wire feed apparatus is moved one pitch by the cylinder 26*a* so that it may perform the next wire binding operation. In this way, the article is bound with the wires in an automatic manner.

Again, the above-described apparatus is exemplary of the type of device which may carry out the bundling operation associated with the present invention.

Through the above-mentioned series of steps of wrapping (inner packaging materials), applying reinforcements and bundling, an article which has a small bulk density and must be free from contamination, such as acetate tow, cotton mixed with staple fibers for sanitary use, and the like, is packed. It is to be noted that in connection with the end surface reinforcements 19*a* and 19*b*, the ears 90*a* and 90*b* may not be necessary. In this special case, the horizontal bands (or wires) 22 shown in FIG. 1(*i*) could be omitted, and the horizontal bundling machine 89 in FIGS. 3 and 9 also could be omitted as well. In addition, in the case of packed bales which do not require the end surface reinforcements 21*a* and 21*b*, the end surface reinforcement stockers 85*a* and 85*b*, the reinforcement feeding devices 86*a* and 86*b*, the bundling machine 84 and the horizontal bundling device 89, could be omitted.

A second preferred embodiment of an apparatus for packing an article according to the present invention will be described with reference to FIGS. 13 to 17.

Figure 13:
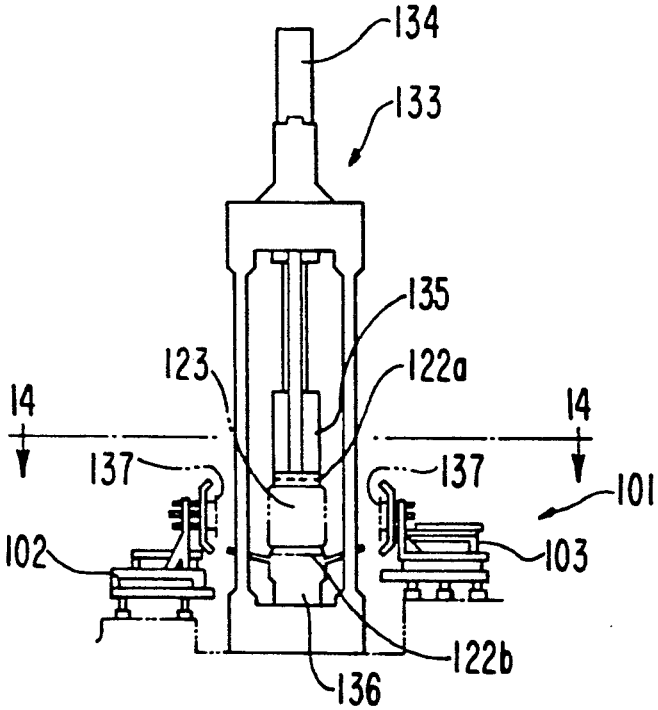
FIG. 13 is a front view of an apparatus for bundling an article to be packed according to a second preferred embodiment of the present invention.
Figure 12A:
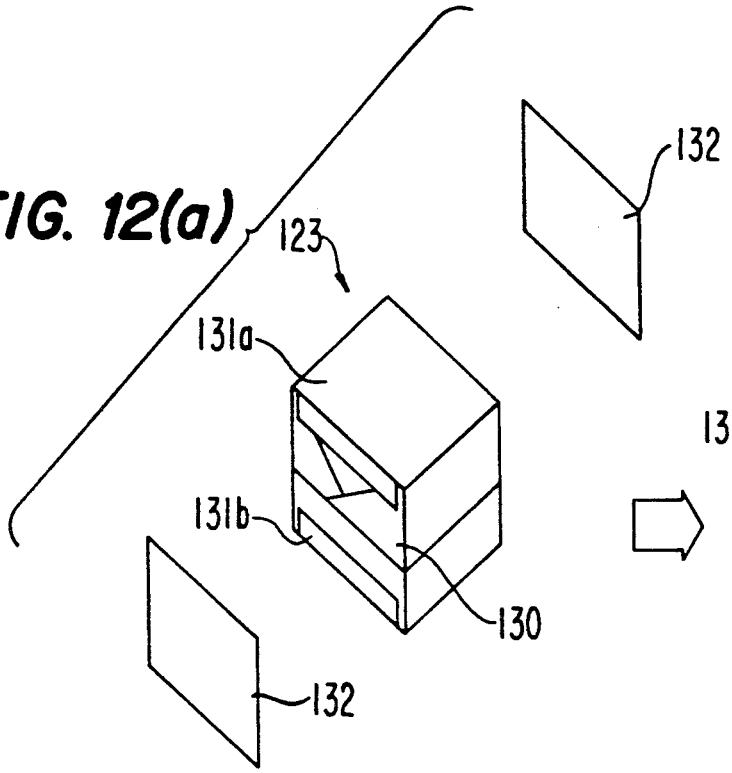
FIGS. 12(*a*)-12(*d*) are schematic diagrams showing the successive steps in another compressive packing method.
Figure 12B:
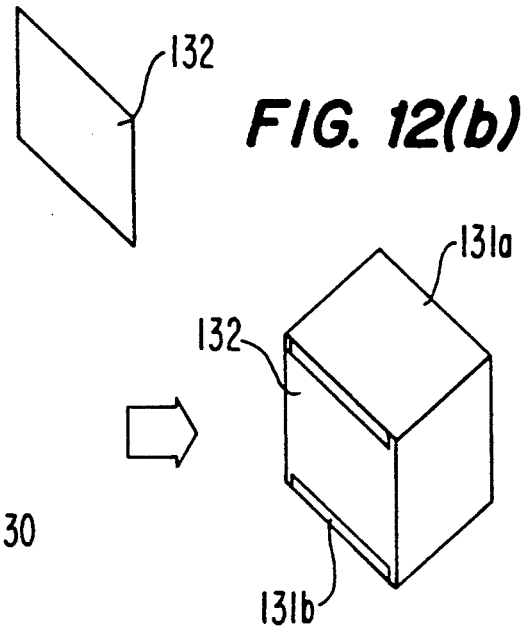
Figure 12C:
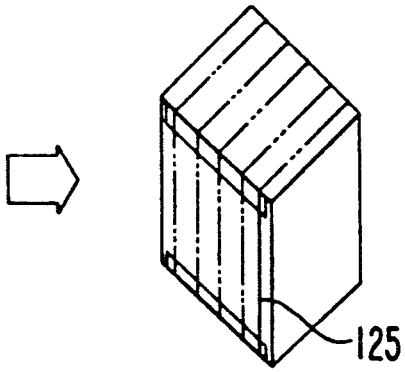
Figure 12D:
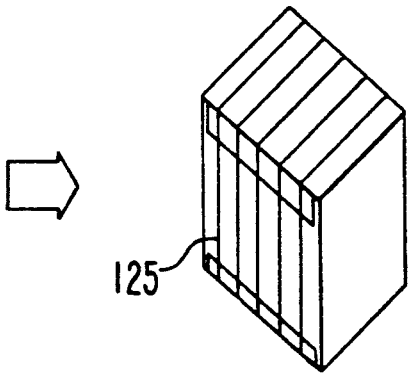
Figure 14:
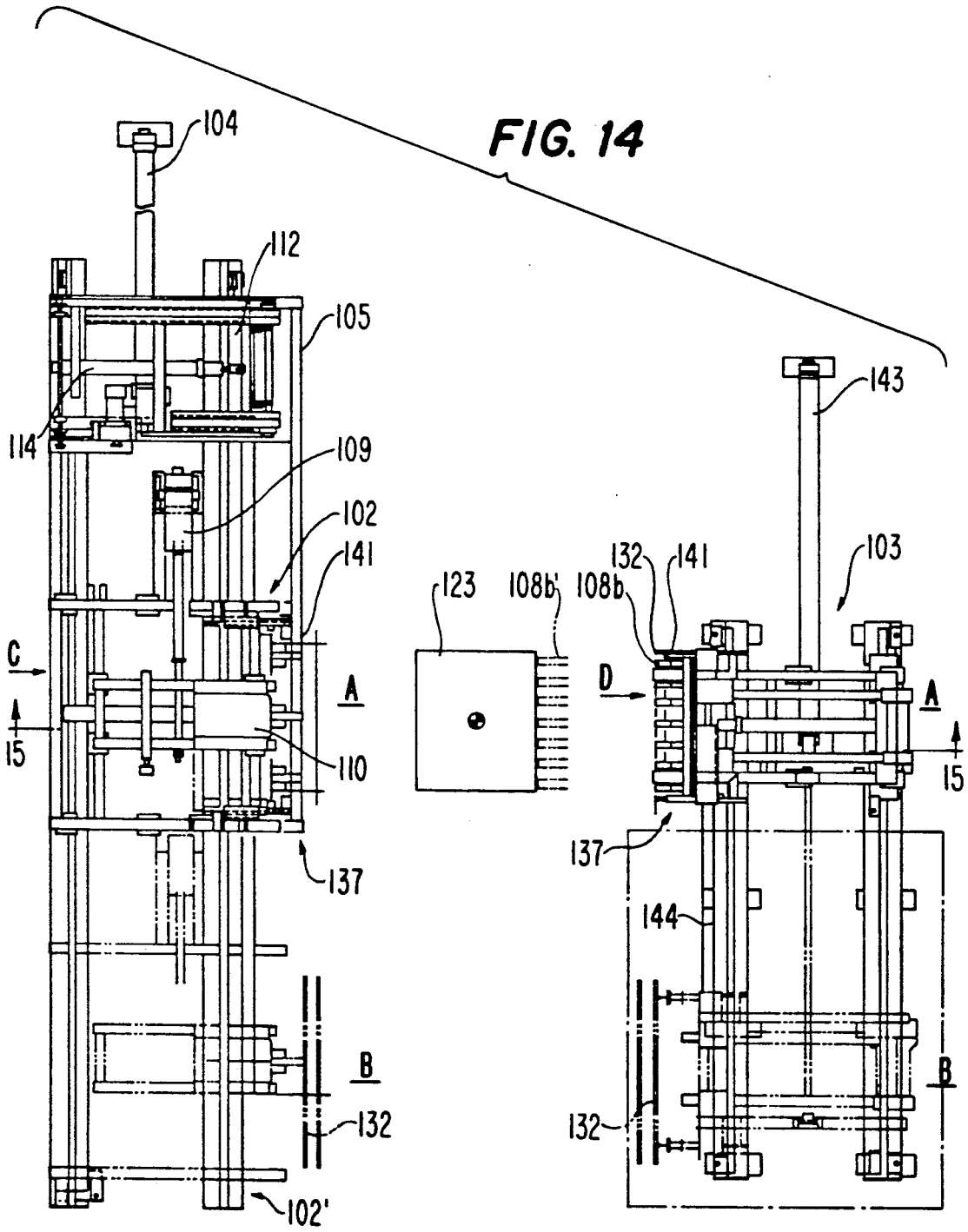
FIG. 14 is a cross-sectional view taken along line 14—14 in FIG. 13.
Figure 15:
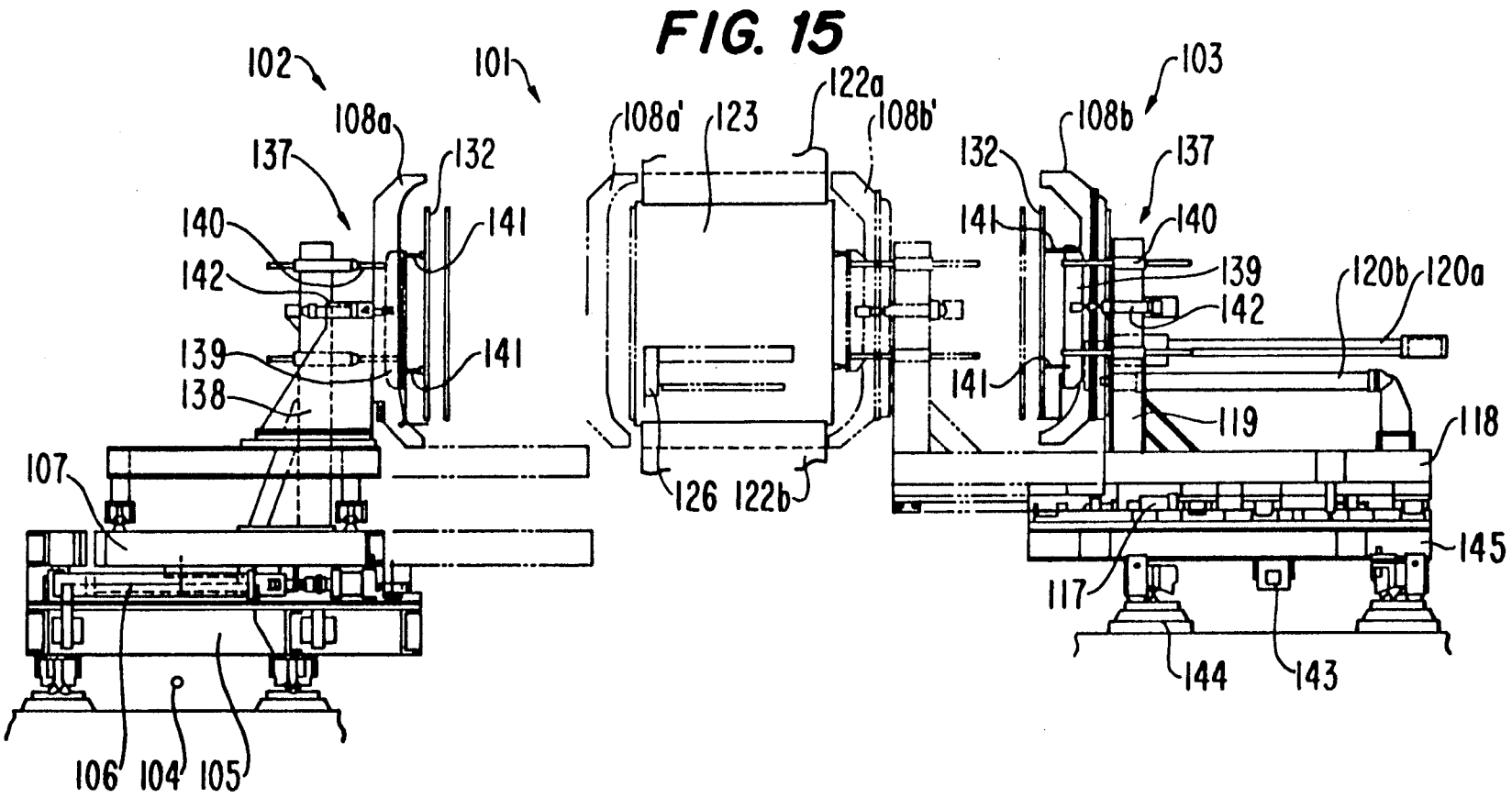
FIG. 15 is a cross-sectional view taken along line 15—15 in FIG. 14.
Figure 16:
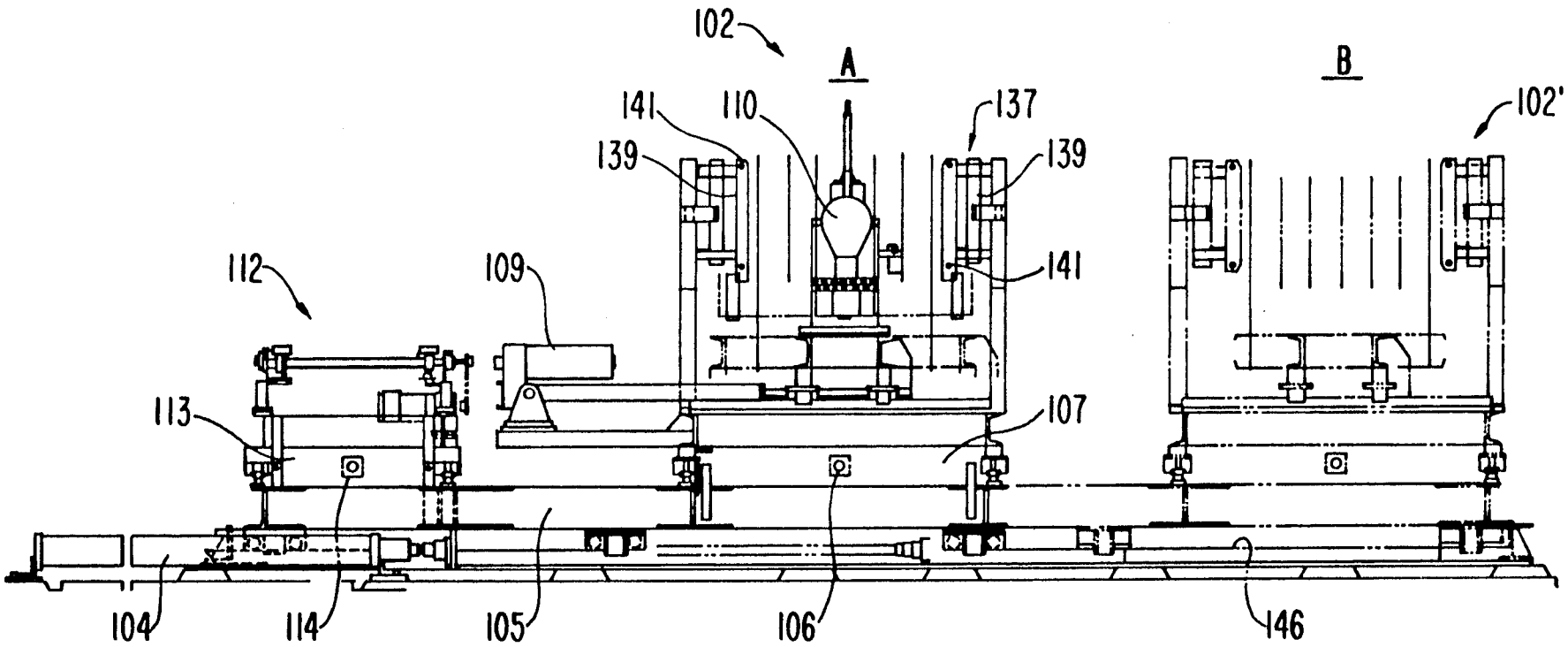
FIG. 16 is a partial side view as seen in the direction of arrow C in FIG. 14.
Figure 17:
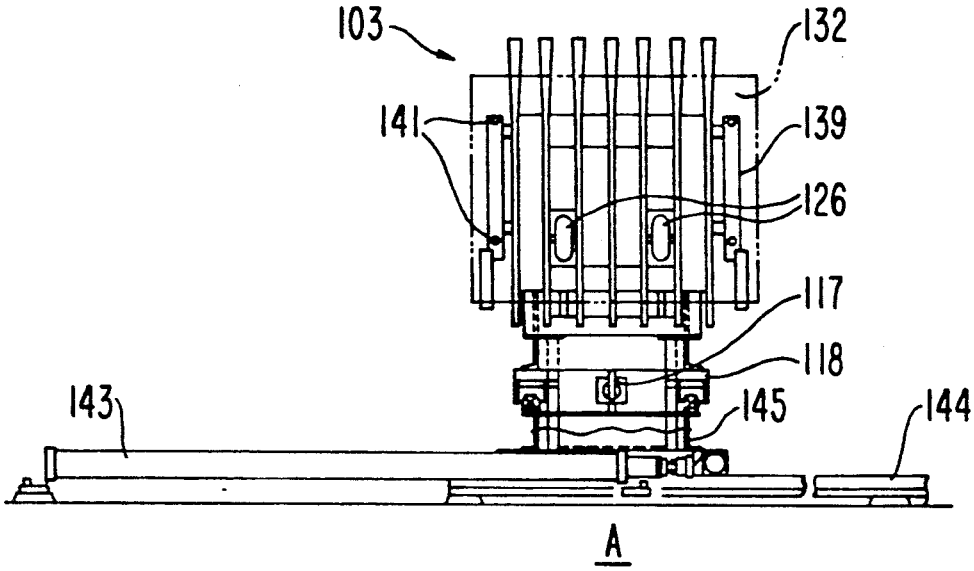
FIG. 17 is a partial side view as seen in the direction of arrow D in FIG. 14.
Figure 20:
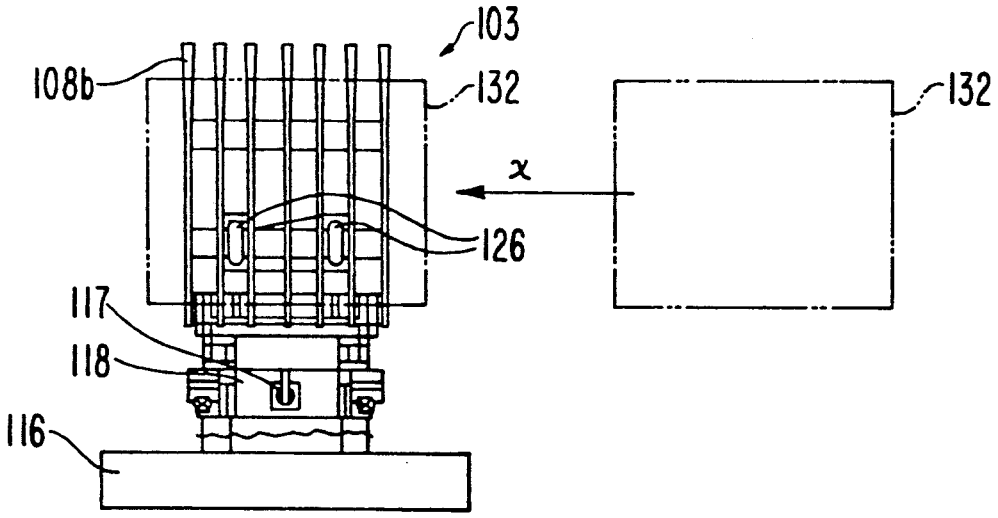
FIG. 20 (PRIOR ART)
FIG. 20 is a partial side view as seen in the direction of arrow F in FIG. 18.
Figure 18:
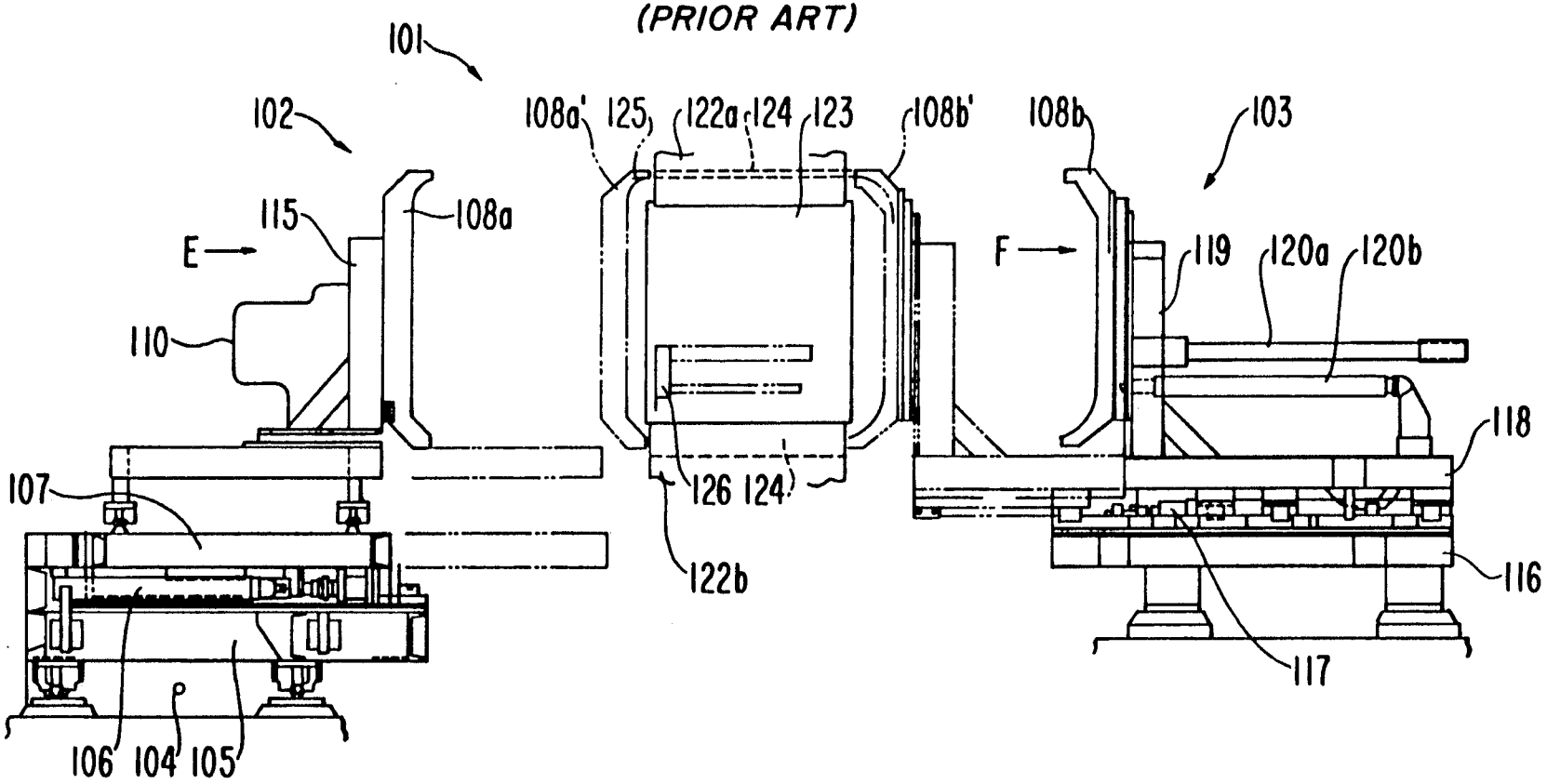
FIG. 18 (PRIOR ART)
FIG. 18 is a front view of one example of a bundling apparatus in the prior art.
Figure 19:
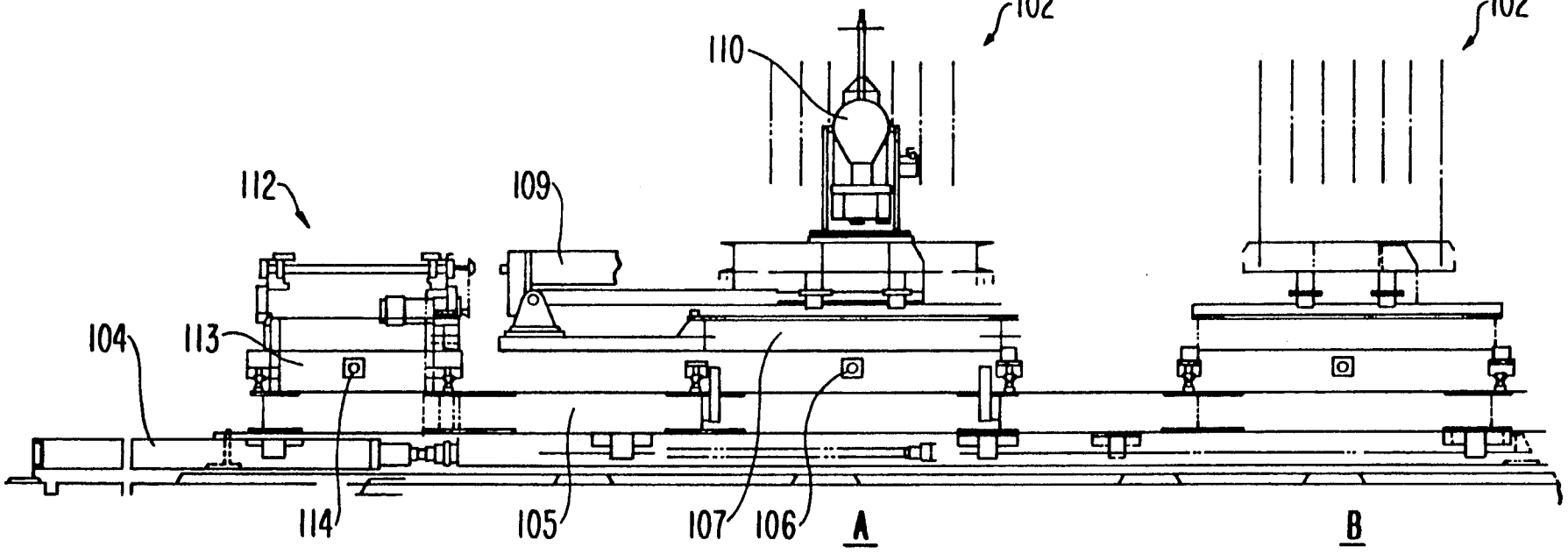
FIG. 19 (PRIOR ART)
FIG. 19 is a partial side view as seen in the direction of arrow E in FIG. 18.

At first, in FIG. 13, reference numeral 133 designates a compressive packing machine main body. Tow or the like is compressed within this compressive packing machine main body 133 by a cylinder 134 via an upper press seat 122*a* and a lower press seat 122*b* to form an article 123. This article is automatically wrapped with wrapping material 130 by means of a lower wrapping device 136 and an upper wrapping device 135. It is to be noted that reinforcements 131*a* and 131*b* are mounted to the upper and lower surfaces of the article 123 in the manner described above in connection with the first preferred embodiment. And the article 123 which has been wrapped with the wrapping material 130, is bundled with bundling belts 125 applied thereto in a series of operations performed by the head side 102 and the guide side 103 portion of the bundling apparatus 101, which correspond to the band applying device 78 and the band guiding device 79, respectively, of the first preferred embodiment.

The apparatus according to the second preferred embodiment of the present invention is characterized in that a reinforcement mounting device 137 is provided in the above-mentioned bundling apparatus 101 for automatically mounting side surface reinforcements 132 to the article, prior to the bundling step.

In the reinforcement mounting device 137, holding frames 138 of the head side portion 102 of the bundling apparatus 101 extend vertically on the opposite sides of the front portion of the upper surface of a table 107, and mount members 139 of a reinforcement holding mechanism are mounted to the same frames 138 via slide mechanisms 140 consisting of guides and the like. A plurality of reinforcement holders (four, in the illustrated embodiment), such as vacuum suction pads 141 or the like are disposed on the mount members 139. However, the holders are not limited to vacuum suction pads since the reinforcement could be held by acicular members. The side surface reinforcement 132, such as a corrugated cardboard sheet, is held by the holder under suction, and the mount member 139 is advanced and retracted by cylinders 142 so as not to interfere with the bundling belt guides 108*a*. In addition, a movable frame 105 is provided with rollers, and is laterally movable along rails 146 as driven by a cylinder 104 between position (A) and position (B).

Likewise, in the guide side portion 103, a mount member 139 is mounted to a frame 119 via a slide mechanism 140, and reinforcement holders such as vacuum suction pads 141 or the like can be advanced and retracted by a cylinder 142 in such a manner as to not interfere with bundling belt guides 108*b*. Furthermore, a movable frame 145 is provided with rollers so that the same frame 145 is laterally movable along rails 144 as driven by a cylinder 143 between position (A) and position (B).

Now the operation of the above-described apparatus will be explained. The head side portion 102 normally assumes the standby position (B). Under this condition, a reinforcement is fed to the reinforcement mounting device 137 by a reinforcement feeding device (not shown). Then, the vacuum suction pads 141 are advanced by the cylinder 142, suck the side surface reinforcement 132 from the reinforcement feeding device, and are retracted to a standby position. Likewise, the guide side portion 103 normally assumes the standby position (B). Under this condition, a reinforcement is fed to the reinforcement mounting device 137 by a reinforcement feeding device (not shown). At this time, the vacuum suction pads 141 are advanced by the cylinder 142, suck the side surface reinforcement 132 from the reinforcement feeding device, and are retracted to a standby position.

When the article 123 has been wrapped and the time has arrived for mounting a side surface reinforcement thereto and for bundling the article, the head side portion 102 is driven jointly with the movable frame 105 by the cylinder 104. Further the head side portion 102 is moved by the cylinder 106 t position (A) via the table 107.

The guide side portion 103 is moved jointly with the movable frame 145 as driven by the cylinder 143. Further the guide side portion 103 is moved to position (A) via the table 118 as driven by the cylinder 117. Next, the bundling belt guides 108*a* and 108*b* are pushed to positions 108*a*' and 108*b*' where small clearances are left between these guides and the upper and lower press seats 122*a* and 122*b*, respectively. Since the vacuum suction pads 141 holding the side surface reinforcements 132 are also advanced as a result of this operation, the side surface reinforcements 132 are also automatically urged against the side surfaces of the article 123 to be packed.

After the bundling machine 110 has advanced a little, paying out a bundling belt 125 and has facilitated a step in the bundling of the article, the same bundling machine 110 is retracted a little. Thereafter it moves laterally to the next bundling belt guide position, and advances a little to continue bundling. In this way, the article 123 is bundled sequentially one by one by the bundling belts 125.

When the article has been bundled, the vacuum pressure of the suction pads 141 on both sides of the article is released. It is to be noted that the vacuum pressure could be released immediately after the side surface reinforcements 132 have been urged against the article 123 to be packed.

Then, the head side portion 102 is retracted by the cylinder 106; the bale take-out conveyor 112 is moved to position (A) by the cylinder 104 via the movable frame 105; and the head side portion 102 moves to position (B) and receives the side surface reinforcement 132 in the above-described manner. In addition, the bale take-out conveyor 112 is pushed by the cylinder 114 against the side surface of the packaged article via the table 113 (after a bale has been completed). The completed bale is pushed out by the bale push-out pushers 120*a* and 120*b* provided in the guide side portion 103, and is loaded on the above-mentioned conveyor 112. Thereafter, the guide side portion 103 moves to position (B) via the movable frame 145 a driven by the cylinder 143, and receives the side surface reinforcement 132. Subsequently, similar operations are automatically repeated.

As will be obvious from the detailed description of the preferred embodiments above, since the method for compressive packing according to the present invention has a characteristic feature in that there is no need to preliminarily combine a reinforcement and a wrapping material set by set as is the case with the prior art method, human labor can be reduced. Also, it is unnecessary to provide temporary storage space. Also, according to the present invention, since the compressive packing operation is carried out automatically, persons are not needed to perform the simple labor associated with the packing operation, nor are persons required to perform dangerous work. And moreover, productivity can be improved by shortening the total cycle time necessary for making one package. Furthermore, if the bundling apparatus according to the present invention is used for practicing the novel compressive packing method, side surface reinforcements can be automatically applied to an article. Hence, workers are not required to perform dangerous works, whereby safety is improved and manpower can be reduced. Moreover, the appearance of the packages is determined without being based on the skill of the workers. Again, the cycle time can be reduced and productivity can be improved.

While a principle of the present invention has been described above in connection with preferred embodiments of the invention, it is intended that all matter described in the specification and illustrated in the accompanying drawings shall be interpreted to be illustrative and not as a limitation on the scope of the invention.

What is claimed is:

1. A method of compressively packing an article exhibiting a bulky tow-like state, said method comprising:

compressing a bulk portion of the article into a cubic or rectangular parallelepipedal shape;

subsequently automatically wrapping the shaped article from above and below with flexible wrapping materials;

automatically applying reinforcements to all of the surfaces of the article, including to the top and bottom surfaces of the article by elevating a pile of reinforcements to a predetermined level with a reinforcement elevator, grasping a top one of the pile of reinforcements with a vertically movable reinforcement lifting device and lifting the top one of the reinforcements above the pile thereof, moving a reinforcement feed truck between the top one of the reinforcements grasped by the lifting device and the remaining pile of reinforcements elevated by the reinforcement elevator, subsequently transferring the top one of the reinforcements from the reinforcement lifting device to the reinforcement feed truck and a top one of the reinforcements in the remaining pile thereof to the bottom of the reinforcement feed truck, and transferring the reinforcements from the top and the bottom of the reinforcement feed truck to the top and bottom of the article, respectively; and subsequently bundling the wrapped and reinforced article with bundling belts.

2. A method as claimed in claim 1, wherein said step of automatically applying the reinforcements comprises automatically applying reinforcements to two opposed side surfaces of the article after the reinforcements have been automatically applied to the top and bottom surfaces of the article, the reinforcements are subsequently automatically applied to the remaining opposed side surface of the article, and wherein said step of bundling includes first wrapping bundling belts around the top and bottom surfaces and the two opposed side surfaces of the article after the reinforcements have been applied thereto, and secondly wrapping bundling belts around the remaining opposed side surfaces of the article after the reinforcements have been applied thereto.

3. A method as claimed in claim 1, wherein said step of automatically applying reinforcements comprises applying reinforcements having marginal portions which overhang the surfaces of the article so as to form ears extending beyond edges of the article at which the surfaces thereof intersect, and folding the ears downward against the article prior to said step of bundling.

4. A method as claimed in claim 2, wherein said step of automatically applying reinforcements comprises applying reinforcements having marginal portions which overhang the surfaces of the article so as to form ears extending beyond edges of the article at which the surfaces thereof intersect, and folding the ears downward against the article prior to said step of bundling.

5. In a machine for packing an article, apparatus for applying reinforcements to the article and for facilitating the bundling of the article over the reinforcements with bundling belts, said apparatus comprising:

a receiving seat for supporting an article to be reinforced and bundled;

a head side and a guide side portion of the apparatus disposed opposite one another across said receiving seat, each of said head side and guide side portions including bundling belt guide means for guiding bundling belts around an article supported on said receiving seat, a reinforcement mounting device having reinforcement holding means for selectively holding and releasing a reinforcement, and cylinder means operatively connected to said reinforcement mounting device for moving said holding means thereof toward and away from said receiving seat independently of and in a non-interfering manner with respect to said bundling belt guide means; and reinforcement feeding means for automatically feeding reinforcements to each said reinforcement mounting device

6. The apparatus in a packing machine as claimed in claim 5, wherein said reinforcement holding means comprises a plurality of vacuum suction pads.

* * * * *